US007331909B2

(12) United States Patent
Middleton

(10) Patent No.: US 7,331,909 B2
(45) Date of Patent: Feb. 19, 2008

(54) SCALABLE HIGH-PERFORMANCE BOUNCING APPARATUS

(76) Inventor: Bruce Middleton, 1483 Lameysville Road Apartment 808, Vancouver, BC (CA) V6H 3Y7

( * ) Notice: Subject to any disclaimer, the term of this patent is extended or adjusted under 35 U.S.C. 154(b) by 672 days.

(21) Appl. No.: 10/779,938

(22) Filed: Feb. 17, 2004

(65) Prior Publication Data

US 2005/0075182 A1 Apr. 7, 2005

Related U.S. Application Data

(63) Continuation-in-part of application No. 10/291,987, filed on Nov. 12, 2002, now Pat. No. 6,716,108, which is a continuation-in-part of application No. 09/799,386, filed on Mar. 5, 2001, now Pat. No. 6,558,265.

(60) Provisional application No. 60/187,167, filed on Mar. 6, 2000.

(51) Int. Cl.
*A63B 21/02* (2006.01)
*A63B 22/14* (2006.01)

(52) U.S. Cl. ..... 482/121; 482/148

(58) Field of Classification Search ..... 482/121–126, 482/148, 77
See application file for complete search history.

(56) References Cited

U.S. PATENT DOCUMENTS

| | | | | |
|---|---|---|---|---|
| 238,042 | A | | 2/1881 | Herrington |
| 438,830 | A | | 10/1890 | Yagn |
| 2,351,145 | A | | 6/1944 | Pearson |
| 2,712,443 | A | | 7/1955 | Hohberger |
| 2,783,997 | A | | 3/1957 | Gaffney et al. |
| 2,796,036 | A | | 5/1957 | Hansburg |
| 2,835,493 | A | | 5/1958 | Skaggs |
| 2,865,633 | A | | 12/1958 | Woodall |
| 2,871,016 | A | | 1/1959 | Rapaport |
| 2,899,685 | A | | 8/1959 | Bourcier de Carbon |
| 3,065,962 | A | | 11/1962 | Hoffmeister |
| 3,116,061 | A | | 12/1963 | Gaberson |
| 3,181,862 | A | | 5/1965 | White |
| 3,205,596 | A | | 9/1965 | Hoffmester |
| 3,351,342 | A | | 11/1967 | Guin |
| 3,773,320 | A | | 11/1973 | Samiran et al. |
| 4,243,218 | A | | 1/1981 | DeSousa |
| 4,390,178 | A | | 6/1983 | Rudell et al. |
| 4,449,256 | A | | 5/1984 | Prueitt |
| 4,508,341 | A | * | 4/1985 | Carrington ..... 473/441 |
| 4,707,934 | A | | 11/1987 | Hart |
| 4,861,022 | A | * | 8/1989 | Boatcallie ..... 482/126 |
| 4,876,804 | A | | 10/1989 | Hart |
| 5,080,382 | A | | 1/1992 | Franz |
| 5,170,777 | A | * | 12/1992 | Reddy et al. ..... 601/33 |
| 5,421,783 | A | * | 6/1995 | Kockelman et al. ..... 472/135 |
| 5,643,148 | A | | 7/1997 | Naville |

(Continued)

*Primary Examiner*—Fenn C. Mathew
(74) *Attorney, Agent, or Firm*—Lerner, David, Littenberg, Krumholz & Mentlik, LLP

(57) ABSTRACT

A scalable high-performance bouncing apparatus provides convenient access to untensioned internally semi-mounted springs/tension elements. A holster retains the inoperative semi-mounted elements and avoids contact or friction with fully engaged tension elements. Adjustable connection elements permit compensation for lengthening of spring elements due to creep or elongation set. The connection elements include collars that compress the tension elements, and may be connected to the springs/tension elements by first stretching the elements beyond their working elongation and then placing the collars onto the stretched portions.

11 Claims, 29 Drawing Sheets

U.S. PATENT DOCUMENTS 5,713,818 A 2/1998 Buitoni
6,123,649 A * 9/2000 Lee et al. ..... 482/54
6,305,674 B1 10/2001 Koivurova
6,352,494 B2 3/2002 McAlonan
6,503,177 B2 1/2003 Herman
6,511,383 B1 * 1/2003 Raidt et al. ..... 472/135
6,558,265 B1 * 5/2003 Middleton ..... 472/135
6,716,108 B1 4/2004 Middleton et al.
2002/0086779 A1 * 7/2002 Wilkinson ..... 482/118
2004/0204294 A2 * 10/2004 Wilkinson et al. ..... 482/54

* cited by examiner

CUTAWAY SIDE VIEW OF LOWER MOUNT

TOP VIEW OF STORAGE RACK

SCALABLE HIGH-PERFORMANCE BOUNCING APPARATUS

CROSS-REFERENCE TO RELATED APPLICATIONS

This application is a continuation-in-part of U.S. patent application Ser. No. 10/291,987, filed Nov. 12, 2002 now U.S. Pat. No. 6,716,108, which is a continuation-in-part of U.S. patent application Ser. No. 09/799,386, filed Mar. 5, 2001, now U.S. Pat. No. 6,558,265, which claims the benefit of U.S. Provisional Application No. 60/187,167 filed Mar. 6, 2000, the entire disclosures of which are hereby expressly incorporated by reference herein.

BACKGROUND OF THE INVENTION

This invention relates generally to ridable bouncing apparatuses and more particularly to such apparatuses which achieve high performance, have radically adjustable spring strength or which employ compound elastomer springs or enclosed thrust assemblies. The invention also relates to ridable bouncing apparatuses that provide features for convenient engagement and disengagement of springs/tension elements, as well as semi-mounted internal storage of the springs/tension elements.

Steel-spring pogo sticks are the dominant form of ridable bouncing apparatus, and forms are known which aspire to high performance or adjustability or which have enclosed springs. High performance (that is, energy storage and return in the kilojoule range) is problematic for steel spring devices because the storage capacity of the material is low: about 80 joules/kilogram. 1000 joules of storage thus requires about 12 kilograms (26 pounds) of spring. An apparatus of such weight would be unwieldy, unappealing and hazardous due to its own momentum. Manufacturers have stopped at about one-third of this level (which still makes for a rather heavy apparatus). A group of engineering students at the Oregon Institute of Technology, however, has produced a pogo stick with a 47-inch custom-made steel spring intended to propel 250 pounds to a height of 5 feet (implying a capacity of 1700 joules, and a spring weight approaching 40 pounds). Their attained height is 18 inches; they express disappointment, and blame the unwieldiness of the design.

No radically-adjustable steel-spring pogo is known, although devices which suggest such a development were discussed as early as 1881. For example, U.S. Pat. No. 438,830 to Yagn in 1890 discloses compound-coil-spring jumping stilts. Several designs which precompress a coil spring to effect a form of adjustability have been presented, for example, in U.S. Pat. No. 238,042 to Herrington in 1881; U.S. Pat. No. 2,793,036 to Hansburg in 1957; and U.S. Pat. No. 3,773,320 to Samiran et al. in 1973. Such pre-compression does not scale the spring (that is, change its strength), and is of little mechanical significance.

Pogo sticks with enclosed coil springs are shown by Hohberger (U.S. Pat. No. 2,712,443 in 1955), Rapaport (U.S. Pat. No. 2,871,016 in 1957) and Gaberson (U.S. Pat. No. 3,116,061 in 1963). Hohberger assembles his molded frame permanently around the coil. Rapaport places a flexible plastic cover around the spring. Gaberson places the spring inside the piston, and adds a frame-attached plunger to compress it. All of these designs are limited by the modest capacity of their steel springs.

Air-spring pogo sticks have achieved commercialization using low-pressure air springs, the air being contained either in a ball-like bladder or in a block of low-density plastic foam. Such devices are successful as children's novelties but are not well-suited to more demanding applications due to the bulk of the entrapped air column. High pressure air springs are theoretically capable of achieving any desired level of performance, and also hold the promise of straightforward adjustability. Their use in pogo sticks was suggested by Woodall (U.S. Pat. No. 2,865,633 in 1958), who stressed the benefit of adjustability, and others (Bourcier de Carbon in U.S. Pat. No. 2,899,685 in 1959; Guin in U.S. Pat. No. 3,351,342 in 1967). There is, however, a practical problem: the energy stored is present in the form of heat at the bottom of the stroke—and due to the relatively large amount of energy and relatively small amount of gas, temperatures of several hundreds of degrees are attained. A leading manufacturer has told me of experiments which ended in dismay when the cylinder became hot enough to burn the jumpers' legs.

Elastomer-powered pogo designs appear in Gaffney and Weaver (in U.S. Pat. No. 2,783,997 in 1957). Their primary concern was with jumping stilts; their pogo design was minimally modified from a conventional tubular design, and had its rubber mounted externally in two bundles, one on either side of the frame tube. These bundles would have made the upper mount about three inches wide—and this unshielded object would rake up and down between the knees and thighs of the jumper on each stroke; if the rider attempted to ride bowlegged to avoid it, his contact with and ability to control the stick (as well as his concentration) would suffer.

Bourcier de Carbon (cited above) shows an elastomer-powered stilt, and appears to be the first in this context to mention that rubber is a more efficient spring material than steel and can provide higher levels of performance. His upper mount is exposed, which is viable for a stilt; he does not show a ridable design.

Hoffmeister (U.S. Pat. No. 3,065,962 in 1962) gives a quantitative statement of the startling superiority of rubber: 18 pounds of steel, he points out, can be replaced by 3.75 ounces of rubber. His mechanical design (which is for jumping stilts), however, is extraordinarily unsafe. He attaches the bottom of the tension spring to the top of the frame tube (rather than the bottom, as shown by Gaffney and Bourcier de Carbon). This results in rod ends projecting past the rider's knees and moving upward relative to the rider as he lands. A jumper landing in a skier's tuck position will strike the ends of the piston rods with his chest at up to 11 mph.

Prueitt (U.S. Pat. No. 4,449,256 in 1984) cites the scalability of rubber-band springs as a virtue of his design. The design is for multi-piston jumping stilts with exposed pistonheads.

In the past, it has been difficult to perform adjustments on bouncing apparatuses. For instance, a user might have to take the apparatus completely apart in order to make adjustments to the spring or other tension element. Therefore, it is desirable to provide convenient access to these and other components that are inside the bouncing apparatus.

Furthermore, a need exists for a relatively large disk foot for use in high-performance pogo sticks. Two university projects have striven for record-setting pogo performance, and both have adopted disk feet. The developers of the BowGo at Carnegie Mellon University have used a disk rigidly mounted on the piston, with a convex rubber pad on the bottom. While this system may permit the BowGo to be used on a lawn, it does little to accommodate uneven ground or tilting of the pogo, and does not distribute the load uniformly over the surface of the disk. A project at the Oregon Institute of Technology has employed a disk foot mounted on a ball joint. While such a system may provide adequate pressure distribution and can accommodate pogo tilts and uneven ground, the ball joint permits the foot to rotate relative to the shaft. Thus, it has little capacity to transmit torque, and will not enable aggressive yaw maneuvers such as, e.g., aerial spins.

Therefore, there is a need for a bouncing apparatus capable of unprecedented performance.

There is also a need for a bouncing apparatus having a thrust function that can be scaled to match the weights and inclinations of a broad range of rider sizes, thus affording each rider an optimal apparatus that exploits the travel available in its linkage.

There is also a need for a bouncing apparatus that shields the rider from the moving parts of the apparatus during operation, but permits convenient access to tension elements for adjustment of spring strength.

There is also a need for a bouncing apparatus having a foot that is capable of tilting in any direction without rotating, and that can be used on soft surfaces such as lawns, and that can offer improved traction on hard surfaces.

There is also a need for a bouncing apparatus with a spring that can conveniently be pre-tensioned for use and relaxed for storage. Similarly, there is also a need to store the spring or tension element internally within the bouncing apparatus in an untensioned semi-mounted fashion.

There is also a need for a bouncing apparatus having a cartridge unit structure that permits convenient removal from the apparatus to allow a user to perform adjustments on tension elements or other components.

Furthermore, there is also a need for a bearing that can transmit torque, so that torque exerted by a rider on the assembly does not cause the carriage to rotate around the piston but rather transmits the torque to the piston.

Springs/tension elements that are overstretched or are load bearing for long periods of time tend to become permanently elongated ("elongation set"). For example, in experiments on speargun bands, which often consist of rubber bands as the tension component for propelling the spear projectile, at least one researcher has found a 10% elongation on bands after one hour at 300% elongation. It is also well known that many elastomeric materials "creep" or relax over time. Natural rubbers may creep on the order of 1.5% per decade of time. Thermoplastic polymers may creep up to 8% per decade. Unfortunately, an overstretched or relaxed spring/tension element may result in a loss of clearance between disengaged elements and the mounts that are used when the elements are engaged and operational. Furthermore, such improperly tensioned components may cause hazardous conditions during operation of the apparatus. Thus, there is a need to address creeping and overstretching.

Another issue concerning the spring/tension element occurs when a cap or end piece is attached to it. Over time, the connection between the spring/tension element and the cap/end piece may fail. This may cause a hazardous condition, and may also require repairs or replacements, which add unwanted costs. Thus, there is a need form improved techniques of attach caps and end pieces to springs and tension elements so that there is an extended lifespan and/or a reduced failure rate.

SUMMARY OF THE INVENTION

The invention provides a ridable bouncing apparatus which has great energy-storage capacity, and whose thrust function is radically scalable to suit the weights and inclinations of a variety of riders. These benefits are achieved through the use of a compound tension spring, and a set of innovations extending to all components of the system which permit the potential benefits of such a spring to be safely and conveniently realized.

The ridable bouncing apparatus includes a carriage assembly that can support a person; a foot alternately retracting toward and extending away from the carriage assembly; and a thrust assembly. The thrust assembly is mounted to the carriage assembly and to the foot and has a force that impels the extension and resists the retraction. The bouncing apparatus includes a shield member protecting the person from contact with at least a portion of the thrust assembly. The thrust assembly has at least one tension element that supplies a tension force. The bouncing apparatus has an access feature that enables engagement and disengagement of the tension element.

The tension assembly preferably includes a linkage and a spring, with the linkage connecting the foot to the carriage assembly and limiting the motion of the foot to a single linear trajectory, motion along which is either retraction or extension, and with the spring acting on the linkage to impel the extension and resist the retraction. The spring preferably includes a set of elongated elastomeric elements, and is scaled by adding or removing individual elements to or from the operative set. The access features are provided to make this operation convenient. In some embodiments these features are apertures which permit spring elements to be physically added to or removed from the apparatus; in some cases doors are provided to cover such apertures during operation. Other embodiments include mechanisms which permit switching of individual spring elements between engaged and disengaged states but leave disengaged elements mounted on the apparatus.

The foot is preferably a relatively large foot mounted on a universal joint, provided both to permit adequate traction when the apparatus is tilted and to reduce ground loading. This reduces the potential for damage to floors and permits use on relatively soft ground such as lawns. The foot preferably includes a gripping surface that provides improved frictional contact with the bouncing surface, e.g., the ground. The gripping surface may comprise a plurality of layers to further reduce the shock of impact when the foot contacts the ground.

A shield requirement exists because the mounts for the spring can be bulky and at least one of them must move quickly, relative to the carriage. The requirement can be met by replacing the conventional slender tube frame with a much larger hollow column whose interior serves as an enclosed channel for the upper mount.

The thrust assembly can include a piston, alternately retracting upwardly toward and extending downwardly away from the carriage assembly, with the foot at a distal end. The thrust assembly can further include at least one bearing, mounted between the carriage assembly and the piston, for easing the retraction and extension and for limiting lateral movement of the piston relative to the carriage assembly. The thrust assembly can further include a set of tension elements mounted to the carriage assembly and to the piston, thereby impelling the extension and resisting the retraction. Preferably, each tension element is mounted so as to permit it to be easily attached to or detached from at least one attachment point, to add it to or remove it from (as applicable) a set of operative tension elements.

Further in those and other embodiments, the access feature can include the channel, when the channel is adapted to enable disengagement and engagement of the tension element by, for example, allowing immediate access to the tension element for adjustment of the tension force. In this regard, the frame can have a panel that can be displaced to allow the immediate access. The access feature can also further include upper and lower mounts within the channel, to which each tension element can be mounted, each of the mounts having an opening through which ends of the tension elements can be passed. The rider can therefore displace the panel and reduce the tension force by removing (disengaging) at least one tension element. Similarly, the rider can displace the panel and increase the tension force by adding (engaging) another tension element, or replacing a previously removed (previously disengaged) tension element. In this regard, each tension element can be individually mountable and demountable.

In other embodiments, the access feature can include an assembly that mechanically engages and disengages tension elements. In such embodiments, it is preferable that the tension elements are not bundled and that the mounts are not bulky. While any suitable mechanism can be used, a preferred embodiment includes snags which have suitable control features at a location accessible by the rider. The snags can be operated by means of the control features to catch hold of a fixture attached to the end of each tension element. Also preferably, a storage rack can be used to put the fixtures of the disengaged tension elements precisely where the snags need them to be when the piston is arrested. The rack can be attached to the piston. Accordingly, disengaged elements remain stretched between the rack and the upper mount, with some tension keeping them snug, and travel up and down with the piston. Preferably, the ends of the tension elements are provided with snaggable fixtures that seat up against the storage rack when the elements are disengaged.

In alternative embodiments, the access feature may comprise one or more slots in the frame of the apparatus. The slots may permit a finger or tool to penetrate into the frame and engage or disengage a tension element. The tension element can be disengaged and remain within the frame. The tool may employ direct force, leverage or another force to engage or disengage a tension element.

In accordance with an embodiment of the present invention, a bouncing apparatus is provided having a carriage assembly, a foot, a thrust assembly and a universal joint. The carriage assembly can support a person. The foot alternatively retracts towards and extends from the carriage assembly. The thrust assembly is mounted to the carriage assembly and the foot. The thrust assembly effects extension and retraction of the foot. The universal joint connects the foot and the thrust assembly.

In accordance with another embodiment of the present invention, a bouncing apparatus is provided comprising a carriage assembly, a foot, a piston and a plurality of tension elements. The carriage assembly can support a user, and includes an exterior shell. The exterior shell defines an interior chamber and enables access to the chamber. The foot is operable to extend away from and retract toward the carriage assembly. The piston effects extension and resists retraction of the foot. The piston connects the foot and the carriage assembly. At least a portion of the piston is within the interior chamber. The plurality of tension elements are in operative contact with the piston, and are contained within the interior chamber. At least some of the plurality of tension elements are individually mountable in an operative state and demountable in an inoperative state with respect to the piston. When a first tension element of the plurality is demounted, the first tension element is stored within the interior chamber.

In accordance with yet another embodiment of the present invention, a bouncing system is provided. The bouncing system comprises a carriage assembly, a foot, a piston, a plurality of tension elements and a tool. The carriage assembly can support a user, and includes an exterior shell. The exterior shell defines an interior chamber and includes an aperture for access to the chamber. The foot is operable to extend away from and retract toward the carriage assembly. The piston connects the foot and the carriage assembly. At least a portion of the piston is within the interior chamber. The plurality of tension elements are in operative contact with the piston, and are contained within the interior chamber. At least some of the plurality of tension elements are individually mountable in an operative state and demountable in an inoperative state with respect to the piston. When a first tension element of the plurality is demounted, the first tension element is stored within the interior chamber. The tool is for mounting and demounting at least some of the plurality of tension elements. The tool includes a handle and an operative portion remote from the handle. The operative portion is capable of being passed through the aperture to effect mounting and demounting.

In accordance with another embodiment of the present invention, a bouncing apparatus is provided comprising a carriage assembly, a foot, a piston and a plurality of tension elements. The carriage assembly can support a user, and has an exterior shell defining an interior chamber. The exterior shell includes an aperture for access to the interior chamber. The foot is operable to extend away from and retract toward the carriage assembly. The piston connects the foot and the carriage assembly. At least a portion of the piston is within the interior chamber. The plurality of tension elements are in operative contact with the piston, and are contained within the interior chamber. At least a first one of the plurality is individually mountable in an operative state and demountable in an inoperative state with respect to the piston. The first one of the plurality includes a hanger for mounting, wherein the user can mount and demount the first tension element by contacting the hanger through the aperture. When the first tension element is demounted, it is stored within the interior chamber.

In accordance with yet another embodiment, a bouncing apparatus comprises a carriage assembly and a cartridge. The carriage assembly has an exterior shell defining an interior chamber. The cartridge is insertible into the interior chamber. The cartridge includes a tension element, a first mount and a second mount. The tension element has first and second ends. The first mount is operable to connect to the first end. The second mount is operable to connect to the second end.

In accordance with another embodiment, a bouncing apparatus comprising a carriage assembly, a piston and a torque-transmitting bearing is provided. The carriage assembly can support a user, and has an exterior shell defining an interior chamber. The piston is slidably associated with the carriage assembly. The torque-transmitting bearing is disposed between the piston and the carriage assembly such that the torque-transmitting bearing permits extension and retraction of the piston, but resists rotation of the piston relative to the carriage assembly.

In accordance with yet another embodiment, a bouncing apparatus comprising a carriage assembly, a foot, a piston, a plurality of tension elements and a torque-transmitting bearing is provided. The carriage assembly can support a user, and has an exterior shell defining an interior chamber. The foot is operable to extend away from and retract toward the carriage assembly. The piston connects the foot and the carriage assembly. The plurality of tension elements is within the interior chamber and mount to the carriage assembly and to the piston. The plurality of tension elements are operable to impel extension and resist retraction. The torque-transmitting bearing is disposed between the piston and the carriage assembly such that the torque-transmitting bearing resists rotation of the piston relative to the carriage assembly.

In accordance with an embodiment of the present invention, a bouncing apparatus is provided. The bouncing apparatus comprises a carriage assembly, a foot, a piston, a plurality of tension elements and a connector. The carriage assembly can support a user, and has an exterior shell defining an interior chamber. The foot is operable to extend away from and retract toward the carriage assembly. The piston connects the foot and the carriage assembly, and effects extension and resists retraction of the foot. At least a portion of the piston is within the interior of the chamber. The plurality of tension elements are in operative contact with the piston, and are at least partly contained within the interior chamber. At least some of the tension elements are mountable in an operative state and demountable in an inoperative state with respect to the piston. The connector is attached to a first end of a first one of the plurality of tension elements, and is operable to adjust a tension of the first tension element.

In an alternative, the bouncing apparatus further comprises a first mount connected to a first portion of the interior chamber and a second mount connected to a second portion of the interior chamber. When the first tension element is in the inoperative state, the first end of the first tension element is mounted to the first mount by the connector, and a second end of the first tension element is demounted from the second mount. In another alternative, the bouncing apparatus further comprises a first mount connected to the first portion of the interior chamber, and the connector includes a variable adjustment means for adjusting the tension of the first tension element.

In a further alternative, the bouncing apparatus further includes a first mount connected to the first portion of the interior chamber, wherein the connector includes a plurality of extensions and grooves adjacent to the extension. The tension of the first tension element is adjustable by raising or lowering the connector so that a selected one of the extensions contacts the first mount. In one example, the extensions may be spaced so that slack is taken up in increments of less than ¼ of an inch. In another example, the extensions and grooves may provide between 2 and 10 levels of adjustment. Alternatively, the connector may be operable to take up slack to compensate for up to a 10% elongation of the first tension element.

In accordance with another embodiment of the present invention, a bouncing apparatus is provided. The bouncing apparatus comprises a carriage assembly, a foot, a piston, a plurality of tension elements, a first mount and a connector. The carriage assembly can support a user, and has an exterior shell defining an interior chamber. The foot is operable to extend away from and retract toward the carriage assembly. The piston connects the foot and the carriage assembly, and effects extension and resists retraction of the foot. At least a portion of the piston is within the interior of the chamber. The plurality of tension elements are in operative contact with the piston, and are at least partly contained within the interior chamber. At least some of the tension elements are mountable in an operative state and demountable in an inoperative state with respect to the piston. The first mount is connected to the interior chamber. The connector has a collar fixedly attached around a pre-stressed collar region of a first one of the plurality of tension elements. The connector is is operable to connect the first tension element to the first mount.

Preferably, the collar region is pre-stressed past a working elongation. Alternatively, the collar region is pre-stressed to an elongation of between 300% and 500%. In an example, the connector further comprises a hanger attached to the collar, and the hanger is mountable to the first mount. In this case, either the collar or the hanger may have a protrusion and the other one may have a recess for receiving the protrusion so that the collar and the hanger are connected together by the protrusion mounted in the recess. In another example, the collar includes a pair of collar segments. The collar segments may be connected to each other by fixation means. The fixation means may comprise reciprocal mating features. In yet another example, the tension elements are comprised of rubber. In a preferred example, the rubber is unfilled natural rubber. In another preferred example, the rubber is a synthetic polyisoprene.

In accordance with yet another embodiment of the present invention, a method is disclosed. The method includes providing an elastomeric tension element that has a collar region, pre-stressing the collar region, and fixedly attaching a collar to the collar region. The collar region may be pre-stressed beyond a working elongation. Preferably, the collar region is pre-stressed to an elongation of between 300% and 500%. In an example, the method may also comprise connecting a hanger to the collar, wherein the hanger is connectable to a mount of a bouncing apparatus. In another example, the collar includes a pair of collar portions, and fixedly attaching the collar includes mating the pair of collar portions together around the collar region.

In accordance with a further embodiment of the present invention, a bouncing apparatus is provided. The bouncing apparatus comprises a carriage assembly, a foot, a piston, a plurality of tension elements and a holster. The carriage assembly can support a user, and has an exterior shell defining an interior chamber. The foot is operable to extend away from and retract toward the carriage assembly. The piston connects the foot and the carriage assembly, and effects extension and resists retraction of the foot. At least a portion of the piston is within the interior of the chamber. The plurality of tension elements are in operative contact with the piston, and are at least partly contained within the interior chamber. At least some of the tension elements are mountable in an operative state and demountable in an inoperative state with respect to the piston. The holster is operable to contain demounted tension elements.

In an example, the demounted tension elements are untensioned. In another example, the holster includes one or more walls for containing the demounted tension elements. In a further example, the holster comprises a rear wall, a plurality of sidewalls extending from the rear wall, and front members connected to at least some of the sidewalls. In this case, some of the front members may be T-shaped. Alternatively, some of the front members may be curved. In yet another option, some of the front members may be arched. A selected one of the demounted tension elements is preferably contained by a portion of the rear wall, a pair of the sidewalls, and a first one of the front members. In another example, there is a clearance of 0.01 to 0.1 inches between a selected demounted tension element and the holster. In a further example, there is a clearance of at least 0.04 inches between a selected demounted tension element and the holster. In yet another example, the holster is dimensioned so that it does not cause friction with the tension elements mounted in the operative state.

DETAILED DESCRIPTION

Figure 1A:
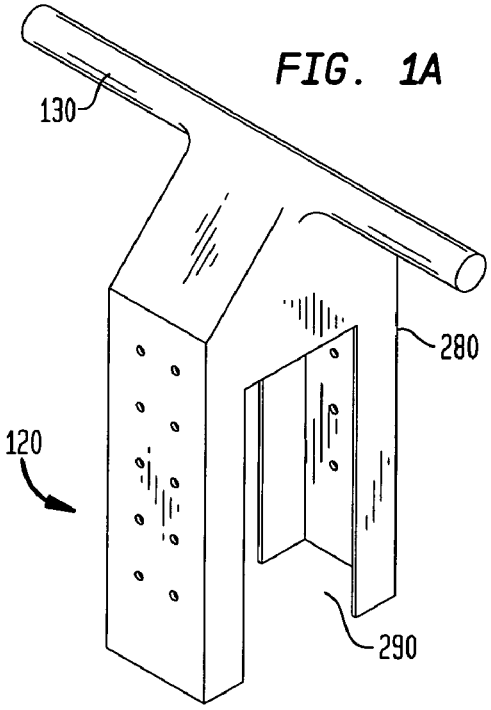
FIGS. 1*a*-1*g* are an exploded perspective view the preferred embodiment.
Figure 1B:
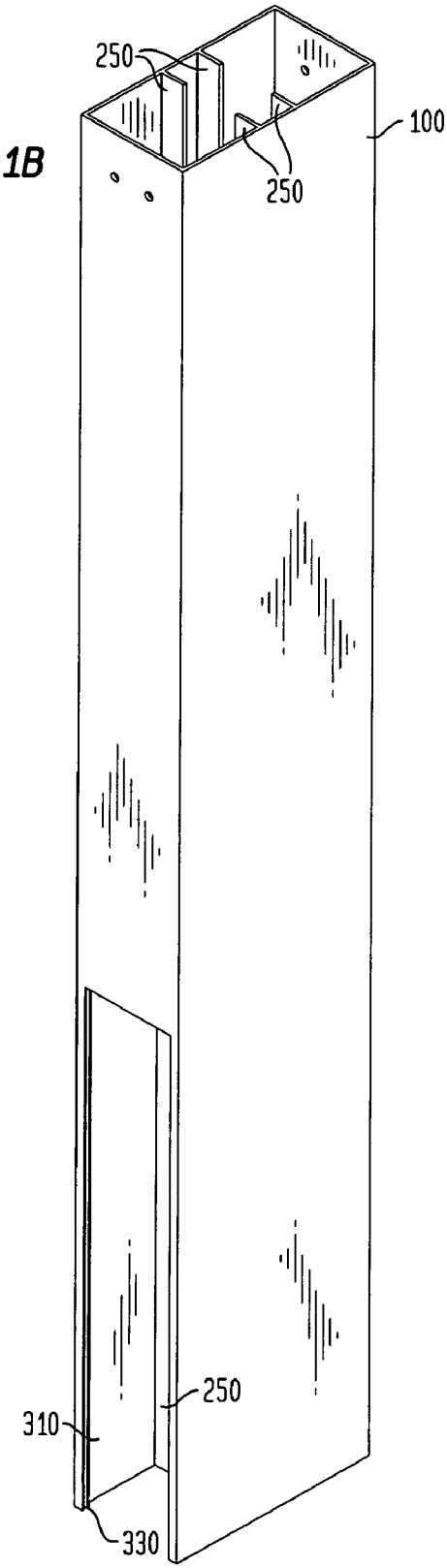
Figure 1C:
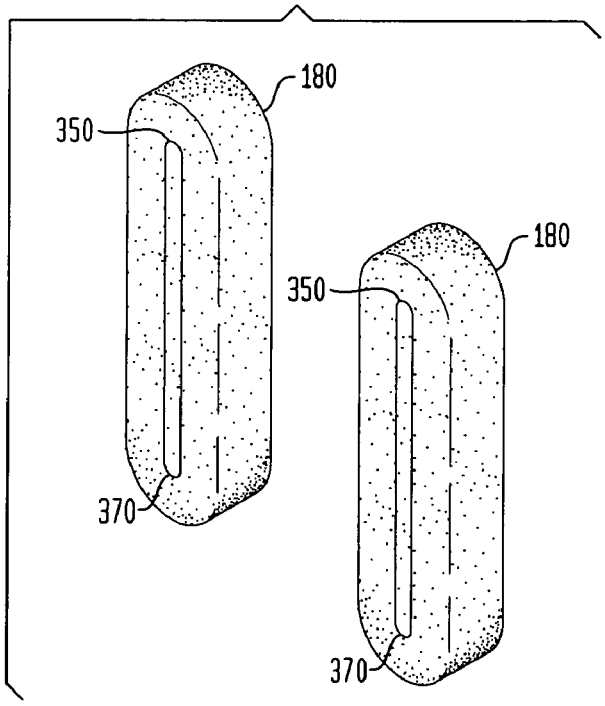
Figure 1D:
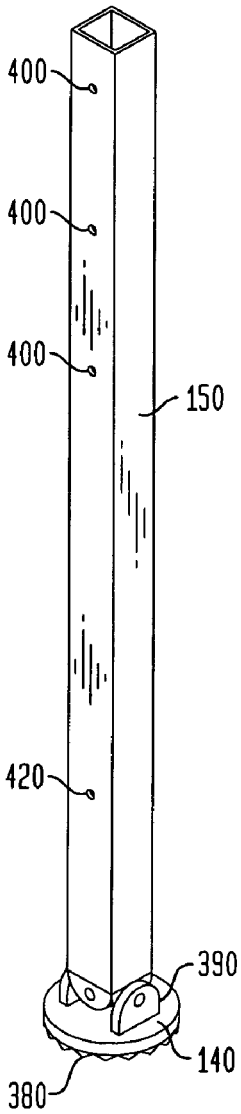

FIGS. 1*a*-1*g*, 2 and 3 illustrate a pogo apparatus which is a preferred embodiment of the invention, in exploded perspective, assembled perspective, and cutaway views. The illustrated pogo apparatus employs a scalable compound elastomer spring, and includes a carriage assembly (including in this embodiment a frame 100, shown in FIG. 1*b*; a lower insert 110, shown in FIG. 1*f*; and a telescoping handle assembly 120, shown in FIG. 1*a*) that can support a rider; a foot 140, shown in FIG. 1*d*, alternately retracting toward and extending away from the carriage assembly; and a thrust assembly that has a tension force that impels the extension of the foot 140 and resists the retraction of the foot 140. The thrust assembly includes a piston 150, shown in FIG. 1*d*, having the foot 140 at a distal end; at least one bearing (including in this embodiment a single bearing 170, shown in FIG. 1*f*) mounted between the carriage assembly and the piston 150 for easing the retraction and extension of the foot 140 and for limiting lateral movement of the piston 150 relative to the carriage assembly; at least one tension element 180 (in this embodiment, a plurality of tension elements 180) shown in FIG. 1*c* (mounted to the carriage assembly at a lower mount or carriage mount 190 of the lower insert 110, shown in FIG. 1*f*, and to the piston 150 via an upper mount or piston mount 200, shown in FIG. 1*g*, that is part of an upper attachment 204, shown in FIG. 1*g*, that is attached to the piston 150) that supplies the tension force, and an arresting assembly (including an upper face 210 of a carriage assembly feature 220 shown in FIG. 1*f* and a lower face 230 of a piston feature 240 shown in FIG. 1*g*).

The frame 100 is a monocoque member—which is to say that it has both a structural function (support of the handle 130) and a containment function (shielding the rider from the thrust assembly), and achieves the structural function by exploiting the strength of the material distributed over the containment shell. Such forms offer several benefits. Piece count and complexity are reduced, because multiple functions are performed by a single element; material requirements are reduced, because containment shells have large dimensions which permit structural loads to be resisted efficiently; and bulk is reduced, because the dead space in and around skeletal frame members is eliminated. In this case the required structural strength is substantial, because the handle is the major control feature in pogo sticks, and is subjected to substantial forces—particularly a backwards pitching force applied by jumpers who tilt the pogo forward during jumping. Nonetheless it is obtained for free: any shell robust enough to be durable under playground conditions will provide ample beam strength in the longitudinal direction. The frame is of deep and narrow configuration primarily for ergonomic reasons: the large sectional area of the thrust assembly fits most comfortably between a rider's feet and knees and interferes least with the biomechanics of jumping when it is so configured. Another benefit is that the strength of the column is maximized in the direction of greatest load. Internal flanges 250 serve primarily to provide structural depth and strength along the lateral axis of the apparatus in the lower area where formation of access apertures has removed the material of the front and back walls. They also anchor lower insert 110. Smaller flanges 260 form tracks within which panels 320 can be slid.

The frame 100 is preferably formed from extruded aluminum; however, any suitable material can be used such as, for example, extruded or molded plastic. In certain less sophisticated embodiments, it may be possible to use wood or other structural materials to construct structural or operational components of the invention. While the frame 100 can be any suitable shape, the illustrated frame 100 has a rectangular section (best shown in FIG. 3) that is 7 cm wide, 12.5 cm deep and 80 cm tall. The corners of the frame 100 are rounded on a 3 mm radius. Each side wall of the frame 100 bears four internal flanges. A first pair 250, 12 mm high, are symmetrically spaced each 1 cm from the midline of the side wall, and serve primarily to provide structural depth and strength along the lateral axis of the apparatus in the lower area where formation of access doors has removed the material of the front and back walls. Each member of a second pair 260, 4 mm high, is symmetrically set in 3 mm from the beginning of a respective corner radius. The side wall material is thickened at each corner to form a quarter-cylindrical bead of 3 mm radius. These smaller flanges 260 and the beads form tracks 330 in which panels 320, also shown in FIG. 1*e*, can be slid.

The carriage assembly can support a rider in an upright position. In this regard, the frame 100 serves as a vertically extending support structure and the lower insert 110 has two pedals 270 on a pedal platform that preferably is 30 cm wide. Also preferably, each pedal 270 has a gripping surface such as, for example, a treaded surface or a rubber surface, to keep the rider's foot from slipping off the pedal 270. The bottom of the frame 100 is open to accept the lower insert 110. Further in this regard, the carriage assembly has at least one handle that can be grasped by the rider. The handle 130 in this embodiment is mounted at an end of the telescoping handle assembly 120. The top of the frame 100 is open to accept the telescoping handle assembly 120. The handle 130 can serve as a control feature and can assist the rider in maintaining contact with the carriage assembly during operation of the pogo apparatus. The telescoping feature of the telescoping handle assembly 120 enables the height of the handle 130 to be adjusted to accommodate the preferences of a variety of riders with regard to handle height.

The telescoping handle assembly 120 is made from any suitable material such as, for example, a high-strength plastic. The handle 130 is preferably 30 cm wide and 2 cm in diameter, and centered on a hollow stem 280 shaped to conform to the inside surface of the top portion of the frame 100 as shown. Slots 290 in the sides of the stem 280 are provided to accommodate the flanges 250 of the frame 100. The stem 280 is inserted into the top of the frame 100, and affixed at a desired height by a suitable fixture mechanism such as, for example, screws passing through holes in the frame 100 and into holes in the stem 280. It should be noted that more sophisticated spring-biased devices are preferable and could utilize notches in the edges of the slots 290 in the stem 280.

When the pogo apparatus is assembled, the frame 100 encloses the bearing 170, the tension elements 180, the arresting assembly, and at least a portion of a path traversed by a proximal end of the piston 150. Accordingly, the frame 100 serves as a shield member that protects the rider from accidental contact with moving parts of the thrust assembly. In this embodiment, the rider is protected from accidental contact with the moving piston 150, the upper attachment 204 (including the piston mounts 200), and the stretching tension elements 180.

The pogo apparatus has an access feature enabling engagement and disengagement of at least one tension element 180. This allows a user to adjust the tension force of the apparatus. When the pogo apparatus is assembled, the frame 100 accepts the lower insert 110 to enclose the tension elements 180 in a channel 300. The access feature in this embodiment includes the channel 300 inasmuch as the channel 300 is adapted to allow immediate access to the tension element 180 for adjustment of the tension force. Desirably, immediate access permits a user to conveniently adjust the tension force within a few seconds. One embodiment uses two sets of tension elements 180 and each set of tension elements 180 is enclosed in a respective channel 300, as best shown on FIG. 3. The adaptation of the channels 300 in this embodiment includes windows 310 in the frame 100 formed inasmuch as the front and back walls of the frame 100 are removed, at the beginning of the corner radius on each side from the bottom of the frame 100, to a height of approximately 30 cm. The adaptation further includes the panels 320 that cover the windows 310. Each panel 320 provides access to a respective set of tension elements 180 as shown. Preferably, the panels 320 are made from a transparent high-strength plastic; however, any suitable material can be used. The panels 320 can be displaced in that they can slide vertically in respective tracks 330 established by grooves formed by the flanges 260 of the frame 100 and the corner beads of the frame 100. A knob 340 on a front of each panel 320 can be gripped by the rider and pushed upward to slide the panel 320 in the respective track 330. In its lowered position, each panel 320 fills the window 310 between the side walls of the frame 100. In its raised position, each panel 320 is concealed within the frame 100 as best shown on FIG. 2.

Displacement of the panels 320 in this manner provides immediate access by the rider to the tension elements 180 for adjustment of the tension force. The access feature also includes the lower mount or carriage mount 190 on the lower insert 110 and an upper mount or piston mount 200 on the piston 150. Each mount 190, 200 has an opening through which ends of the tension elements 180 can be passed. That is, when a tension element 180 is mounted, it is not enclosed by either mount 190, 200. More specifically, an upper end 350 of the tension element 180 is mounted to the piston mount 200 by passing a loop of the upper end 350 over a guard 360 on the piston mount 200. Similarly, a lower end 370 of the tension element 180 is mounted to the carriage mount 190 by passing a loop of the lower end 370 over a guard 360 on the lower mount 190. The guards 360 prevent the tension element 180 from slipping off the mounts 190, 200. In this regard, each tension element 180 is individually mountable and demountable. The rider can therefore displace the panel 320 and reduce the tension force by removing (manually disengaging) the tension element 180. Similarly, the rider can displace the panel 320 and increase the tension force by adding (manually engaging) another tension element 180, or replacing a previously removed (previously manually disengaged) tension element 180.

Figure 13:
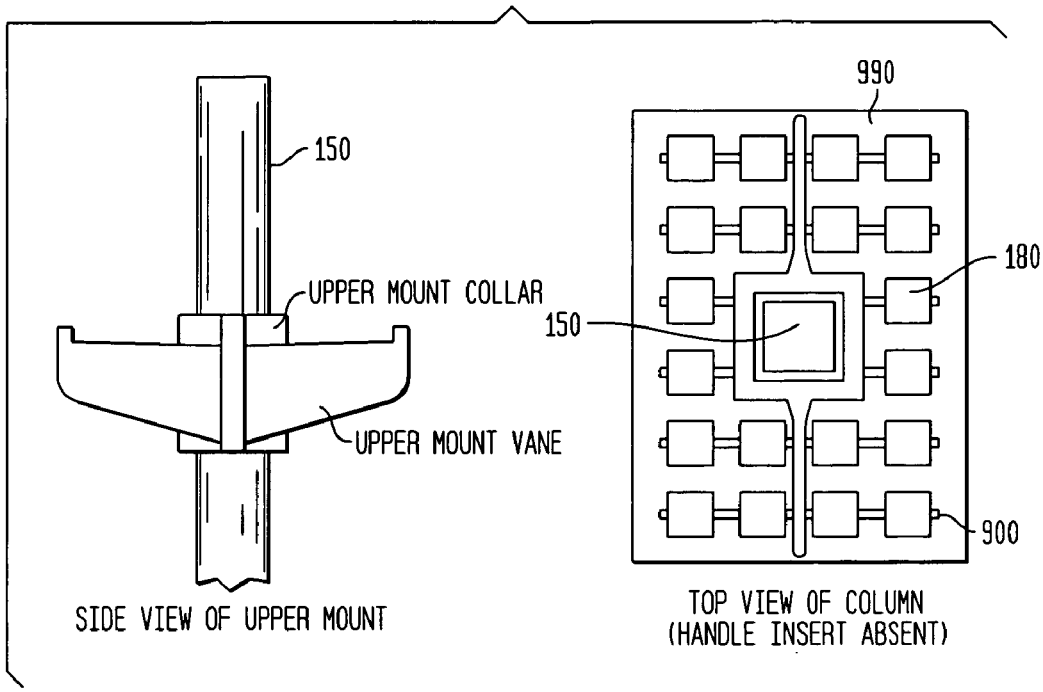
FIGS. 13-15 illustrate features of a mechanical assembly that can be used to mechanically engage and disengage tension elements of the invention.
Figure 14:
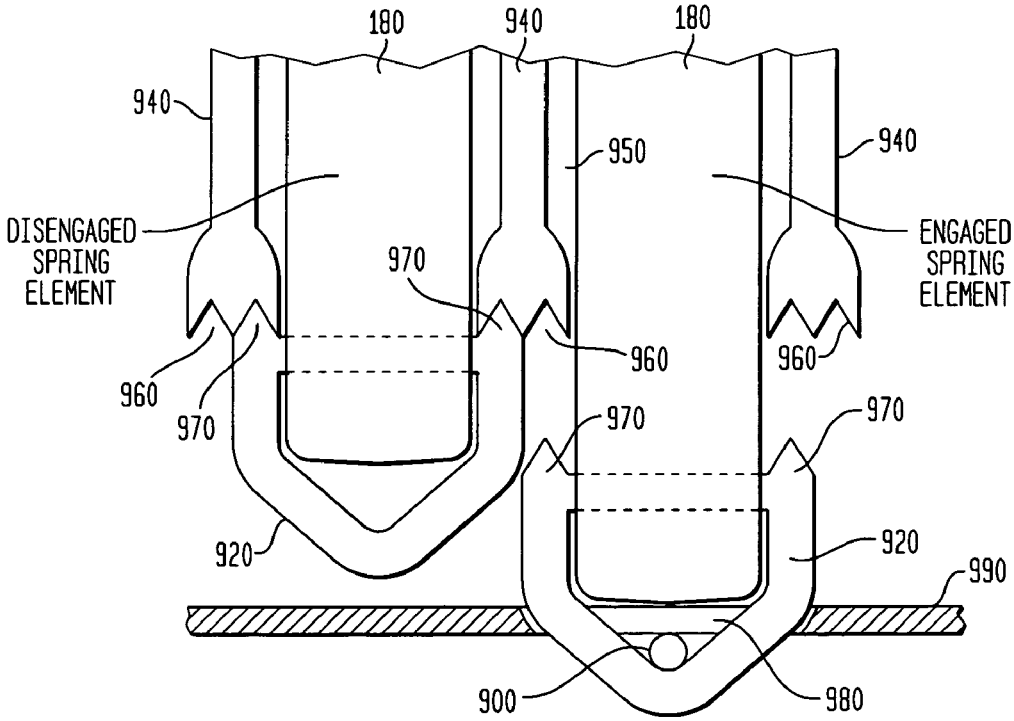
Figure 15:
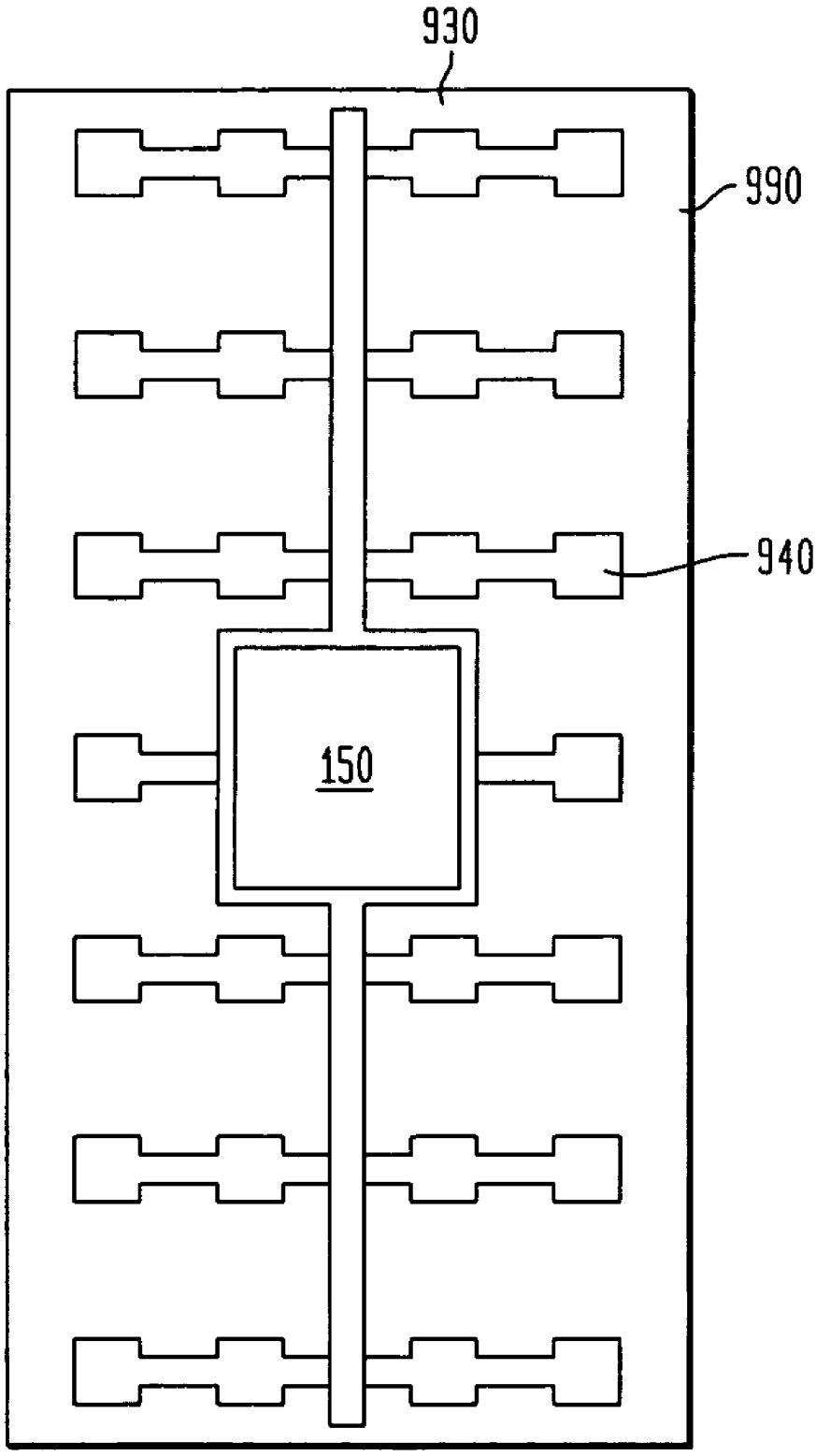

Some embodiments of the apparatus may include mechanical components by means of which the user may effect the engagement and disengagement of tension elements without directly contacting the elements. A primary benefit of such systems is that the need for apertures in the shell large enough to admit a finger, and for doors to cover those apertures during operation, can be eliminated. Another benefit is that the convenience of the engagement and disengagement operations may be increased. FIGS. 13-15 illustrate a suitable mechanism that uses tension elements 180 shaped, for example, as rectangular rods. The mounts 900 include snags in the form of pins, although any suitable type of snag or engagement mechanism can be used. The mounts 900 have control features that are at a location accessible by the rider. As illustrated, the control features are on the bottom of the pedal plate 990. The tension elements 180 are provided with triangular metal loops 920 as snaggable fixtures. Actuation of the control features causes the pins to catch hold of the loops 920. A storage rack 930 is attached to the piston 150 and puts the loops 920 of disengaged tension elements 180 precisely where the pins 900 need them to be when the piston 150 is arrested. The rack 930 includes a set of vanes 940 which extends into gaps 950 between tension elements 180 and catch the two upper corners of the triangular loop 920 attached to any disengaged tension element 180. Sockets 960 on the vanes 940 can mate with the upper surfaces of the triangular loops 920 very precisely, as illustrated by protrusions 970. The tension of the tension element 180 will ensure that the triangular loop 920 will seat properly in the socket 960, which effects the required precise positioning. The lower corners of the triangular loop 920 poke through holes 980 in the pedal plate 990 when the piston 150 is fully extended. The tension elements 180 are engaged by sliding pins into these protruding triangles. The bottom of the pedal plate 990 will sport approximately 20 such pins. When the piston 150 retracts, engaged tension elements 180 remain attached to the pedal plate 990 and stretch, while disengaged tension elements 180 withdraw their triangular loops 920 from the holes 980 as they rise with the piston 150. In other words, the sliding movement of the pins causes the pins to extend through and engage the loops 920. Opposite movement causes the pins to withdraw from and disengage the loops 920. While this mechanism has been disclosed in connection with the preferred embodiment, it should be understood that the same or another suitable mechanism can be used to engage and disengaged the tension elements of any embodiment of the invention. Furthermore, engagement and disengagement may occur in different ways than described above. By way of example only, engagement and disengagement may be effected by rotary motions around a vertical and/or a horizontal axis. The tension element 180 may be demountable at an upper end or a lower end. As described with respect to this embodiment, the disengaged tension element 180 preferably remains within the frame 100. This "semi-mounted internal storage" provides the added benefit that only one end of the tension element 180 must be attached or detached to effect mounting or demounting. Furthermore, semi-mounted internal storage can utilize the same vertical channel for the operative (mounted) and inoperative (demounted) states, thereby avoiding additional cost and/or complexity of a distinct storage channel.

Figure 17:
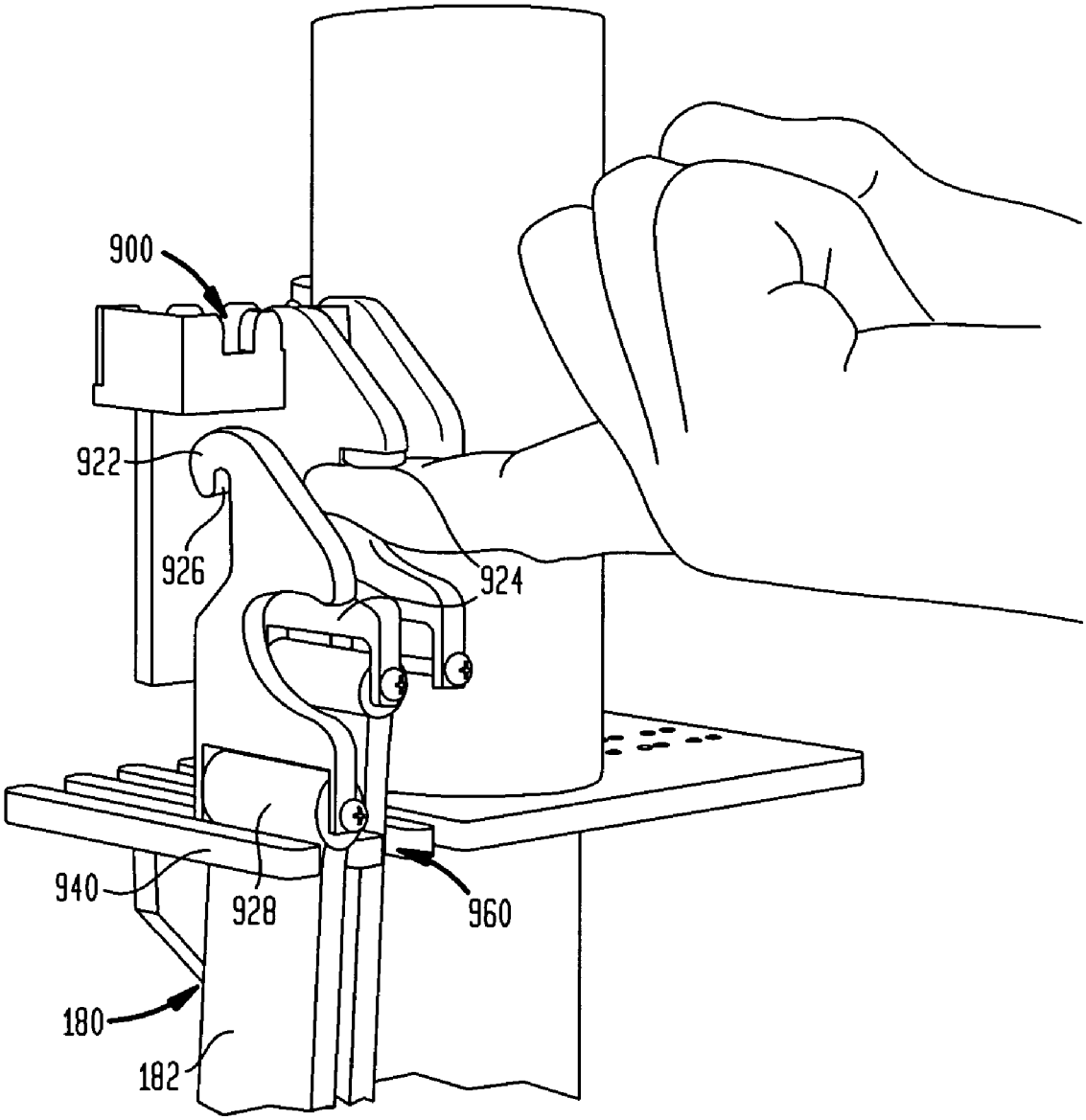
FIG. 17 illustrates manual engagement of a tension element in a semi-mounted internal storage system.
Figure 18A:
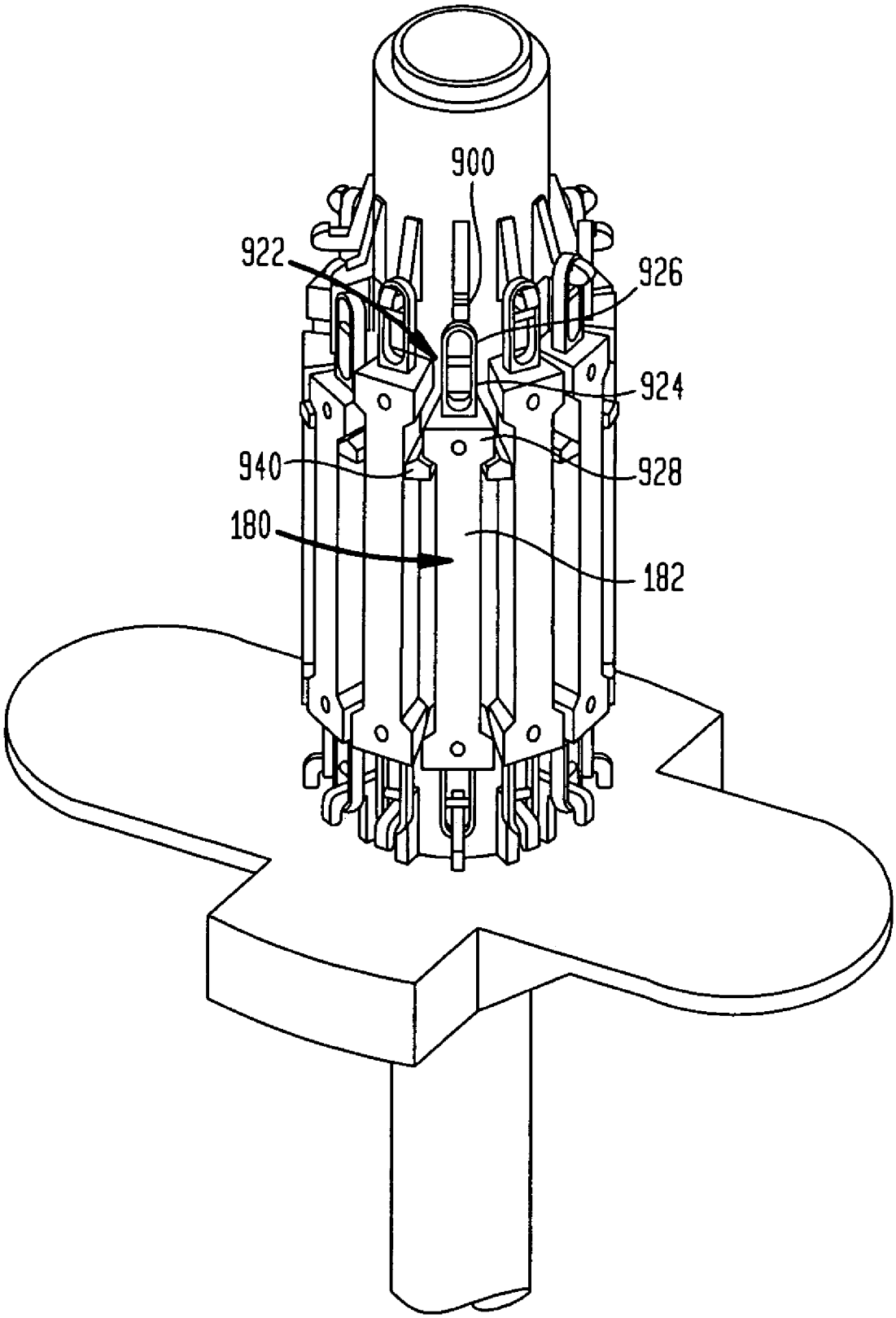
FIGS. 18*a* and 18*b* illustrate an example of a semi-mounted internal storage system.
Figure 18B:
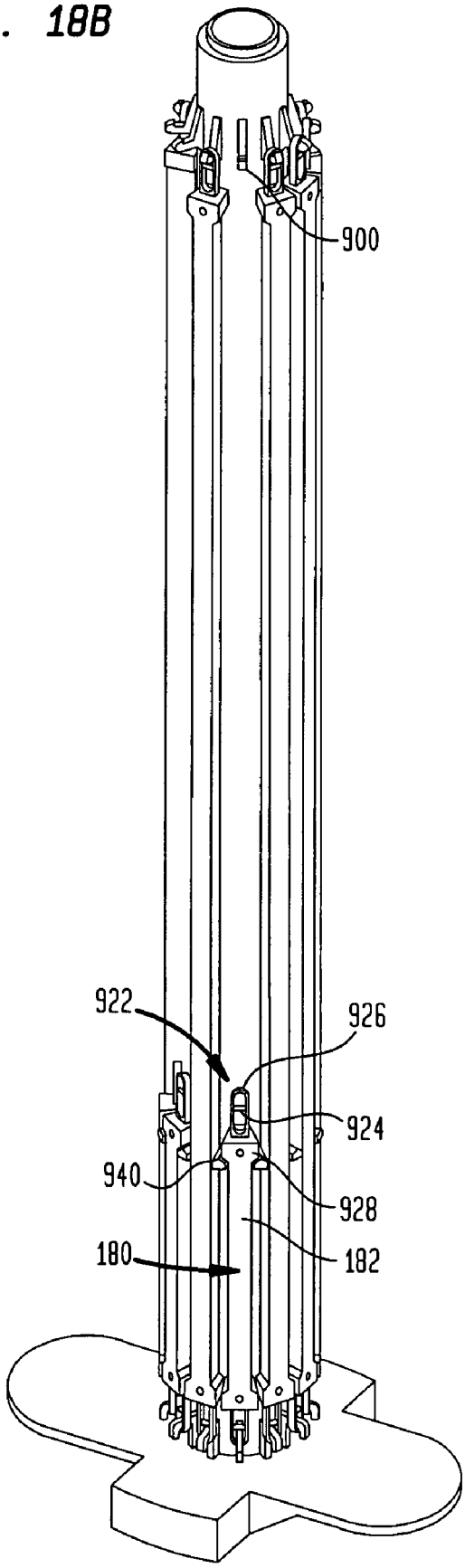
Figure 19A:
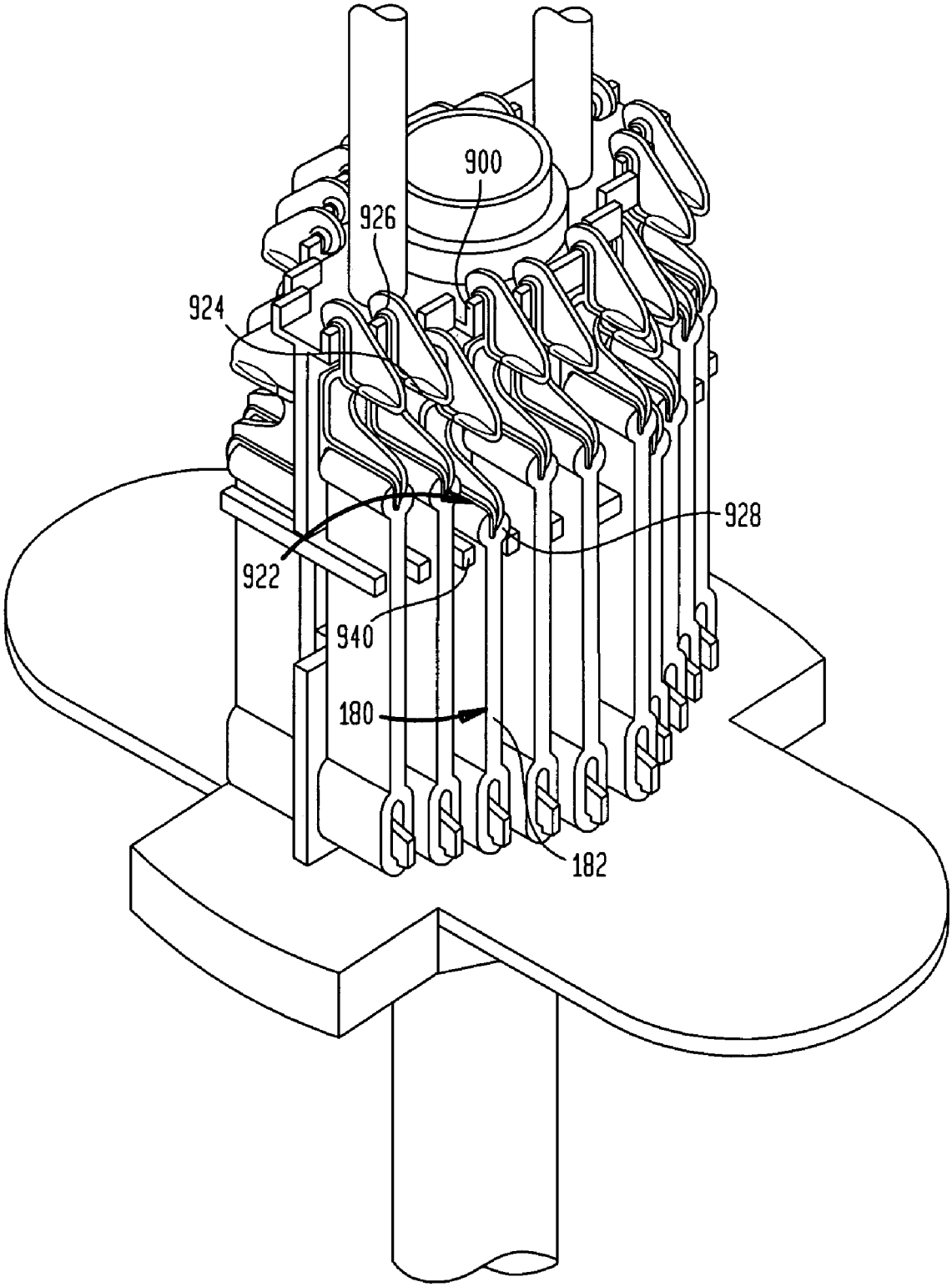
FIGS. 19*a* and 19*b* illustrate another example of a semi-mounted internal storage system.
Figure 19B:
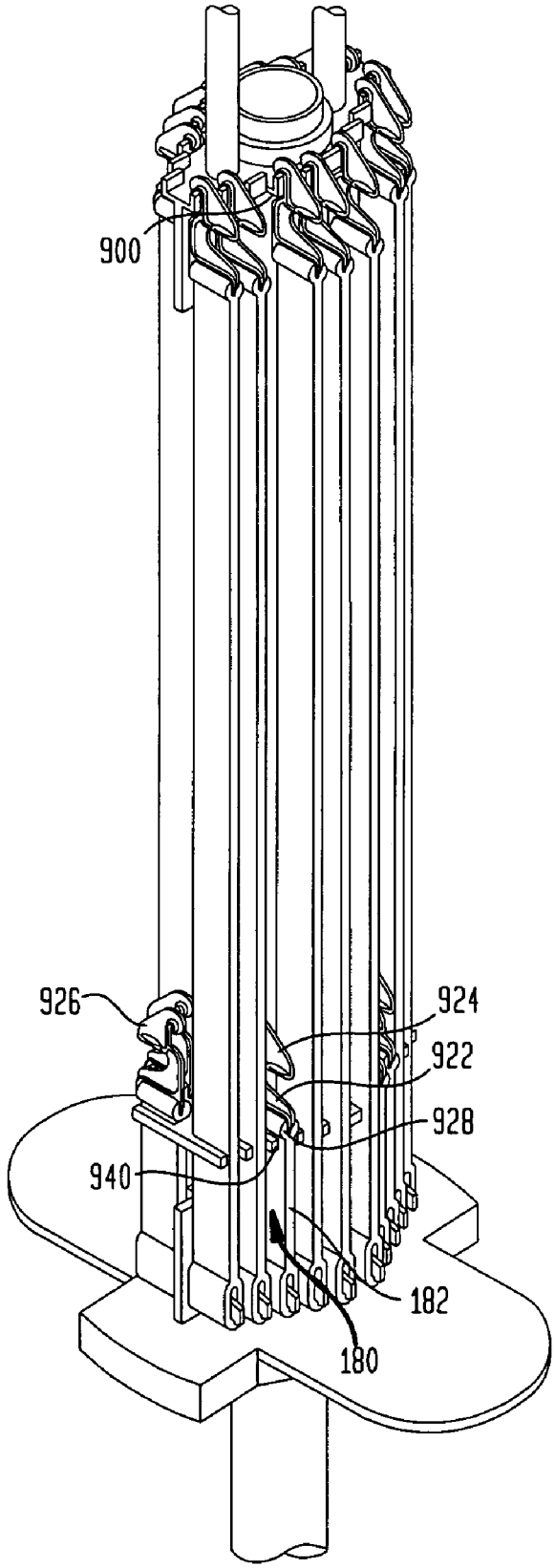

FIG. 17 illustrates a semi-mounted internal storage embodiment wherein the tension element 180 is mounted or demounted by direct manual contact. Specifically, the figure shows actuation using a finger, which may engage the tension element 180 through an access feature such as the panel 320 or through a slot in the frame 100 (not shown). The system permits mounting and demounting by means of a single fingertip, without requiring a grip on the tension element 180. This is beneficial in that the size of the slot or other form of access feature may be reduced and the convenience of operation increased. The tension element 180 preferably includes an elastomeric member 182 and a hanger 922 connected to an end of the elastomeric member 182. Alternatively, the elastomeric member 182 and the hanger 922 form a unitary structure. Desirably, the hanger 922 is formed of a rigid material. The hanger 922 preferably includes a contact portion 924 and an engagement portion 926. The contact portion 924 enables the finger to mount or demount the tension element 180. As shown in the figure, the contact portion 924 is a recess. However, the contact portion 924 may be a protrusion, lip, knurl or other contact mechanism that enables the finger to mount or demount the tension element. In this embodiment, mounting the tension element 180 occurs by raising the contact portion 924 such that the engagement portion 926 releasably attaches to the mount 900. In this embodiment, the mount 900 is a recess that the engagement portion 926 hooks over. Vertical pressure on the contact portion 924 lifts the demountable end to a position in which it engages the mount 900. A slight horizontal translation of the hangar 922 may be required to clear the mount 900 during engagement or disengagement. As shown, the engagement portion 926 may be a hook. However, any other suitable engagement means may be employed. Disengagement/demounting occurs in a reverse process. Once the engagement portion 926 is detached from the mount 900, the tension element 180 is stored by the vanes 940 on either side of the tension element 180. Upper faces of the vanes 940 provide a seat for the demountable end of the tension element 180 in the disengaged state. A slight residual tension in the tension element 180 may be used to effect secure seating. A bulge 928, which may exist where the elastomeric member 182 meets the hanger 922, can be exploited as a retaining knob. Such a retention system is effectively passive, and operates without requiring the user to locate and engage a retaining feature. FIGS. 18*a* and 19*a* illustrate examples of a disengaged tension element 180 when engaged tension elements 180 are not in tension. FIGS. 18*b* and 19*b* illustrate examples of a disengaged tension element 180 when engaged tension elements 180 are in tension. FIGS. 18*a,b* and 19*a,b* show different types of hangers 922 having different connections to the elastomeric members 182.

Figure 20A:
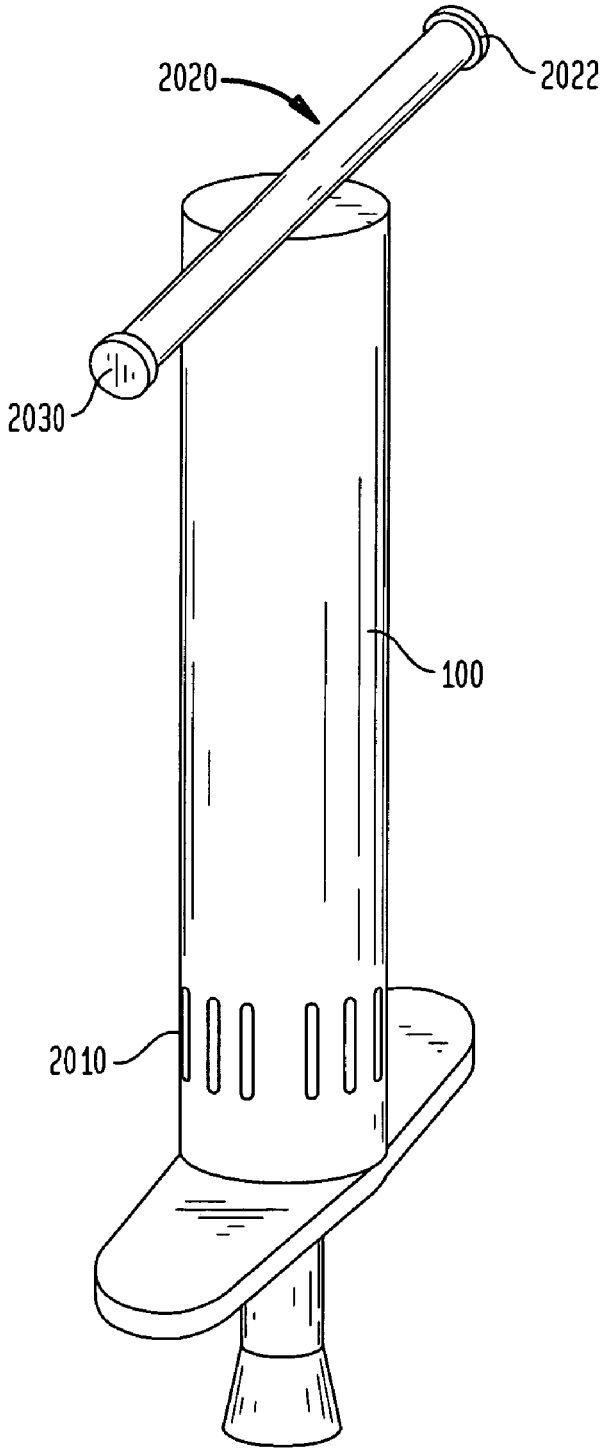
FIGS. 20*a-d* illustrate semi-mounted internal storage systems employing a tool mounting device.
Figure 20B:
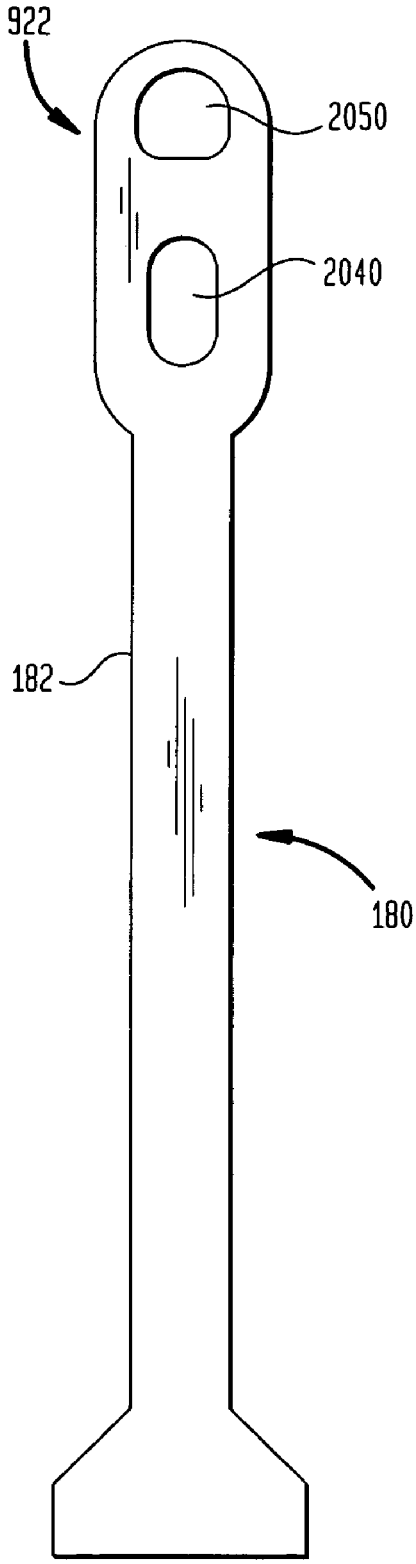
Figure 20C:
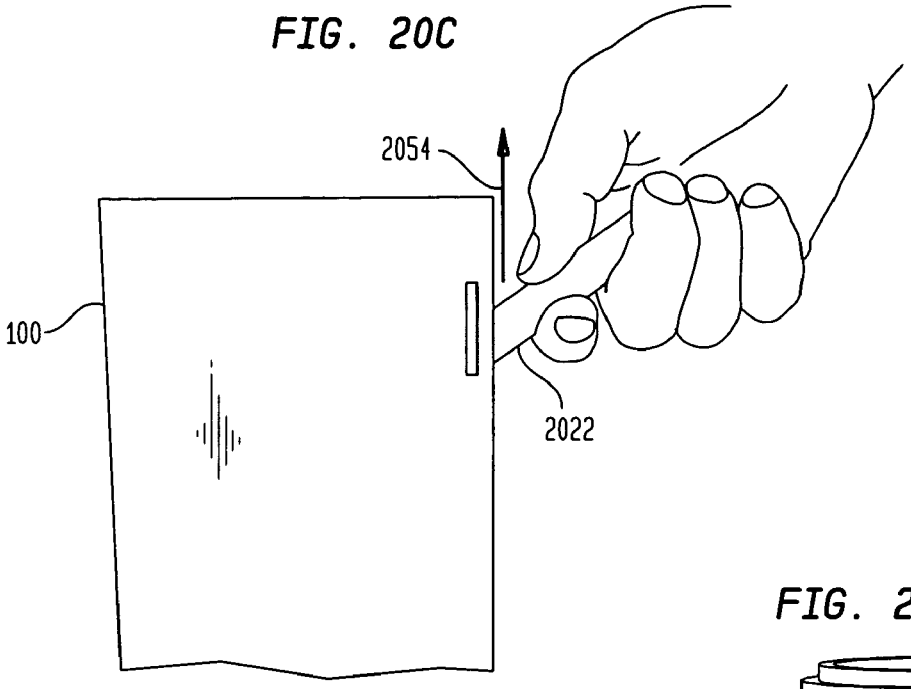
Figure 20D:
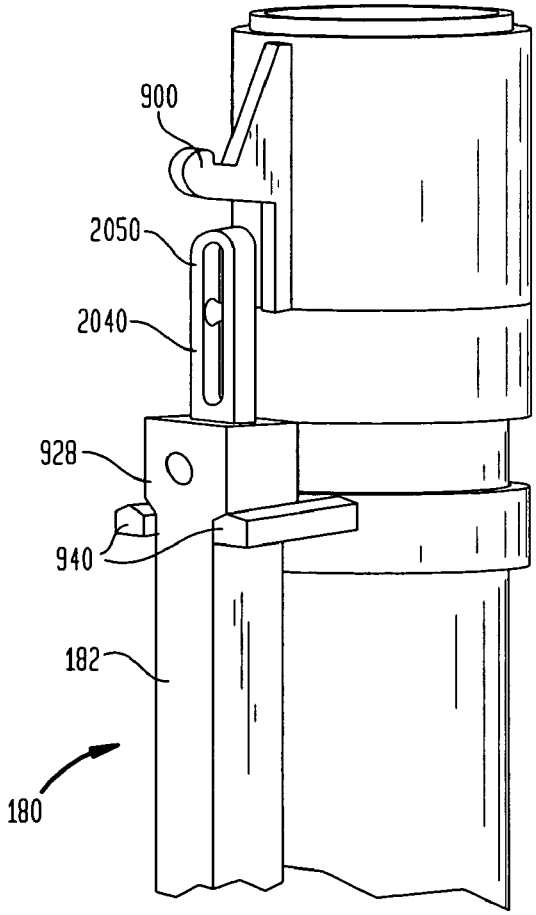

While the user may engage or disengage a tension element 180 through the panel 320 or through a slot in the frame 100, it may be preferably to avoid manual engagement/disengagement. Therefore, in an alternative embodiment, a tool mounting system is preferably employed to mount and demount tension elements 180. FIGS. 20*a-d* and 21*a-b* illustrate examples of such systems. As shown in FIG. 20*a*, the frame 100 includes one or more access slots 2010 through which a tool 2020 can mount and demount the tension elements 180. The tool 2020 preferably includes a handle 2022 at one end and a mechanism 2030 at an opposite end to contact the tension element 180. The mechanism 2030 preferably includes a slender tip which fits through the access slot 2010. In a preferred example, the access slot 2010 is narrower than a human finger. This prevents accidental injury to a user. As shown in FIG. 20*b*, the tension element 180 preferably includes a tool hole 2040 and an engagement hole 2050. Alternatively, a single hole may be used for both the tool hole 2040 and the engagement hole 2050. The user may engage the tension element 180 on a mount 900 (shown in, e.g., FIGS. 14 and 17-19) by, for example, lifting the tool 2020 in a substantially vertical path 2054, as shown in FIG. 20*c*. The mechanism 2030 contacts the tool hole 2040 such that the tool 2020 maneuvers the engagement hole 2050 into engagement with the mount 900. The tool 2020 is then disengaged from the tool hole 2040. The demounting operation works in reverse fashion. The disengaged tension element 180 is shown in FIG. 20*d* resting on vanes 940.

Figure 21A:
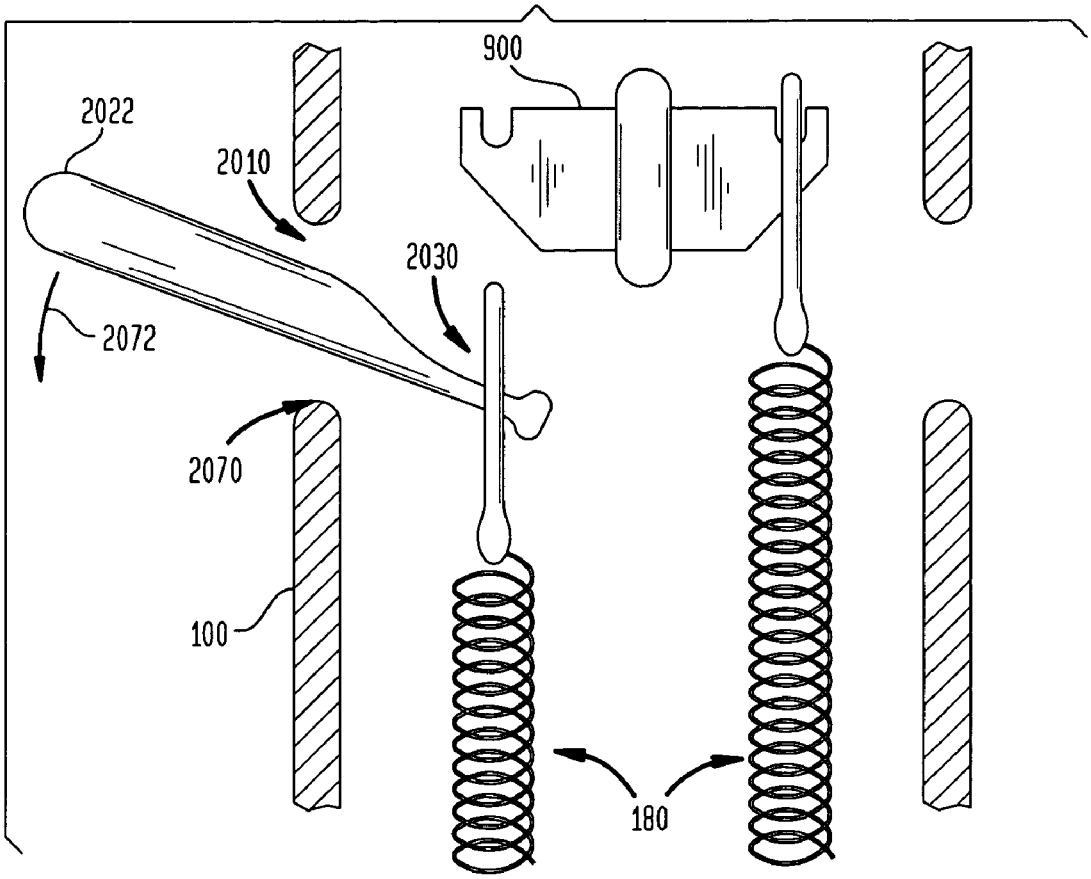
FIGS. 21*a* and 21*b* illustrate semi-mounted internal storage employing a lever tool mounting device.
Figure 21B:
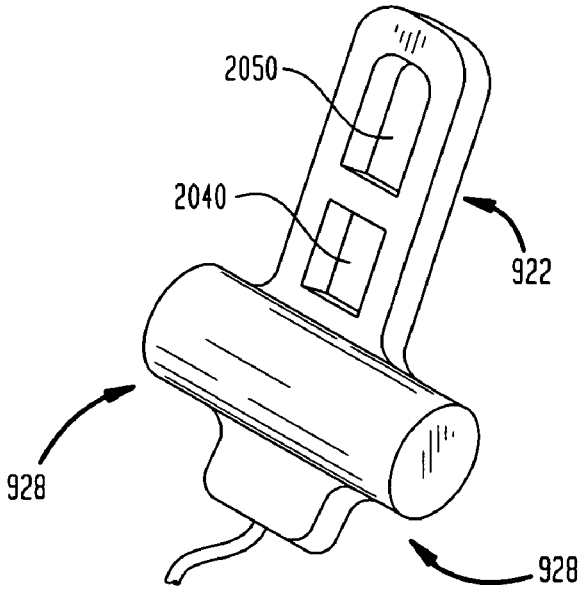

FIGS. 21*a* and 21*b* illustrate an example wherein the tool 2020 is a lever tool 2060. The lever tool 2060 uses an end 2070 of the access slot 2010 as a fulcrum to provide mechanical gain when engaging and disengaging the tension element 180 with the mount 900. Such a tool is particularly suitable in high-tension devices or when the user is not strong enough to effect direct engagement/disengagement. The lever tool 2060 may be used as follows. The lever tool 2060 is inserted through the access slot 2010. A center portion of the lever tool 2060 rests on an end of the access slot 2010 and the mechanism 2030 contacts the tool hole 2040. A downward force 2072 is exerted on the handle 2022, causing the lever tool 2060 to pivot such that the mechanism 2030 raises the tool hole 2040 upward. This action is continued until the engagement hole 2050 reaches the level of the mount 900. The lever tool 2060 may then be pushed further into the frame 100, causing the engagement hole 2050 to engage the mount 900. Downward pressure on the handle 2022 is then released and the lever tool 2060 is disengaged from the tool hole 2040. The demounting operation works in reverse fashion.

For either tool system, the tension element 180 may be stored internally as described above. The tool 2020 or the lever tool 2060 is preferably stored on or within the frame 100. A lanyard or other means (e.g., hook and loop fastening system, magnet, etc.) may be provided to secure the tool 2020 or lever tool 2060. The invention is not limited to the specific engagement systems described above. Any releasable connection means may be employed. Additionally, the tension element 180 of this and other embodiments of the present invention may be an elastomeric member, a coil spring or another type of tension element. As shown in FIG. 21*a*, the tension elements 180 are coil springs, e.g., steel coil springs. Steel coils have excellent resilience and durability, but are much heavier than elastomeric members of the same capacity, and thus may be best suited for relatively low performance applications, e.g., pogo sticks for small children.

The piston 150 is a 70 cm length of a 2.5 cm square tube of a high-strength alloy, preferably of steel or aluminum. However, a piston of any suitable cross-section can be used such as, for example, a piston having a solid cross-section, a hollow cross-section, any polygon-shaped cross-section, or any cross-section having a non-enclosed shape (such as, for example, a cross or an asterisk). Preferably, the shaft of the piston 150 has a set of operating holes 400, and a storage hole 420, to enable adjustability of piston travel, as will be described in greater detail below. Preferably, the foot 140 is a disk that has a relatively large area of approximately a 7 cm diameter. In preferred embodiments, the foot 140 also has a lower gripping surface 380 such as, for example, a rubber surface or a grated surface. More preferably, the lower gripping surface 380 preferably comprises a resilient high-friction material or layered system of materials to improve frictional contact and to dissipate the shock of impact when the foot 140 contacts a bouncing surface, e.g., the ground. The lower gripping surface 380 preferably covers the entire section of the foot 140 which contacts the bouncing surface. Preferably, the foot 140 is attached to the piston 150 by a universal joint 390. The universal joint 390 allows the piston 150 to be tilted in any direction relative to the foot 140 but prevents rotation of the piston 150 relative to the foot 140. Therefore, the large area and other features of the foot 140 permit the pogo apparatus to be used on relatively soft surfaces such as, for example, lawns, and affords improved traction (e.g., frictional bond) on hard surfaces. The ability to tilt the shaft permits the foot 140 to conform to the ground when the shaft is tilted or used on sloping ground. Combined with a large area of foot 140 (e.g., the gripping surface 380), this provides that there will be a large area of contact with the ground and an appropriate distribution of pressure over the contact area. Such a combination results in modest loadings despite the large thrust generated by the apparatus. The non-rotation of the foot 140 provides the rider with yaw control, the ability to execute spins and affords the rider with good directional control.

The bearing of the invention can be any suitable type of bearing. For example, a roller bearing or a sliding bearing can be used. The bearing in this embodiment is a single sliding bearing 170 that is provided by the lower insert 110. The single sliding bearing 170 is one example of a torque-transmitting bearing, wherein torque exerted by the rider on the carriage assembly does not cause the carriage to rotate around the piston 150, but is instead transmitted to the piston 150. To the extent that the piston 150 is fixed (e.g., rotationally fixed) by the frictional bond to the ground, the piston 150 will exert a reaction torque on the carriage assembly that will be transmitted to the rider. The rider will thus be able to effectively push against the ground to launch himself into spins, with the torque transmitted from the carriage assembly to the piston 150 to the foot 140 to the ground. Because the torque is transmitted through several links, it is important that components in the links, e.g., the carriage assembly, the piston 150 and the ground 140, can manage the transmitted torque.

Figure 16:
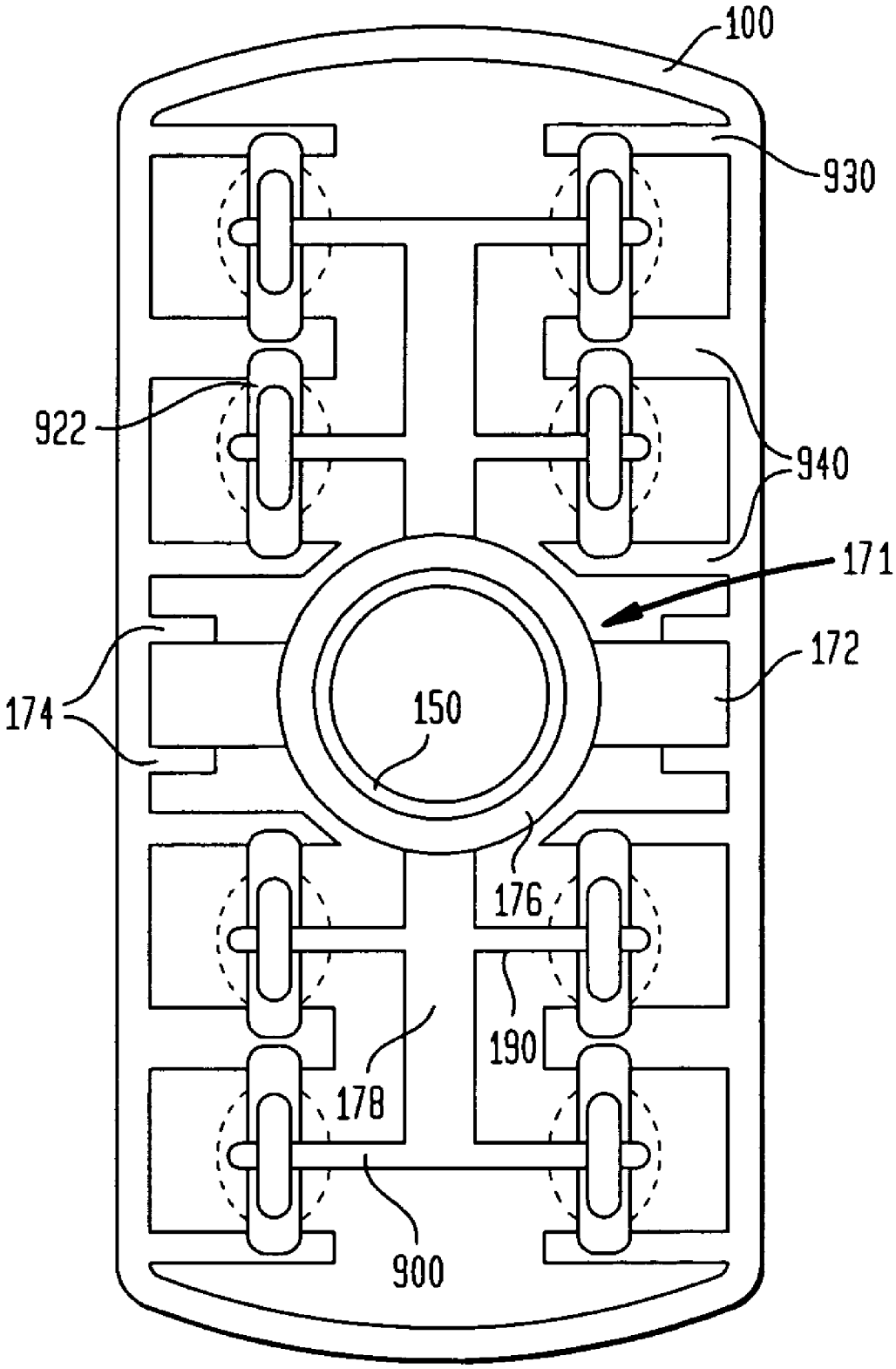
FIG. 16 illustrates a cross-sectional view of a slidable torque-transmitting bearing.

Another form of torque-transmitting bearing is illustrated in the cross-sectional view of FIG. 16. The bearing in this form is attached to the piston 150 and slides against an interior surface of the carriage assembly. In the illustrated embodiment the bearing is integral with an upper mount component 171. Alternatively, the bearing may be separate from upper mount component 171 and attached separately to piston 150. In the illustrated embodiment the bearing comprises a pair of knobs 172 projecting from the upper mount component 171, while the carriage assembly includes two pairs of flanges 174 to bracket the knobs 172 and form vertical channels in which the knobs 172 may travel. Many other configurations are possible; for example, the pairs of flanges 174 may be replaced by single flanges and the single knobs 172 may be replaced by pairs of knobs which bracket the single flanges. The upper mount component 171 includes a collar 176 which rings the piston 150, a pair of branching mount arms 178 projecting from front and back faces of the collar 176, and knobs 172 projecting from either side of the collar 176. The upper mount component 171 may be a unitary molding of a high-strength, low friction material such as acetal. Alternatively, the upper mount component 171 may comprise facings (e.g., one or more bearings) of a low friction material affixed to a high-strength structure such as an aluminum casting. It should be noted that, in both the carriage-mounted and the piston-mounted forms of torque-transmitting bearing, more sophisticated embodiments may employ roller bearings in place of the illustrated sliding bearings.

Returning to FIG. 1*f*, the lower insert 110 includes a vertical column that is 20 cm high. The column includes a square tube with a central bore 170 that accommodates the piston 150. The column also includes the mount 190 for the lower ends 370 of the tension elements 180. In this embodiment, two mounts 190 are provided by two vanes 190 projecting laterally from the front and back faces of the tube, extending from a location 5 cm above the pedal platform to the top of the column. The vanes 190 are faced at their lower ends with semi-oval guards 360 for retaining the tension elements 180 on the carriage mounts 190.

Given that the lower insert 110 has both structural and bearing functions, a high-strength low-friction material such as acetal or nylon is preferable. The piston 150 has a square cross-section, and the central bore 170 has a square cross-section accommodating the piston 150. This piston and bearing configuration eases the retraction and the extension of the piston 150, prevents axial rotation of the piston 150, and limits lateral movement of the piston 150 relative to the carriage assembly.

The arresting assembly limits the extension of the piston 150. The arresting assembly in this embodiment includes the upper face 210 of the carriage assembly feature 220 and the lower face 230 of the piston feature 240. Contact of the faces 210, 230 limits the extension of the piston 140 downwardly away from the carriage assembly. In embodiments, such as this embodiment, where the arrest is provided by the contact of surfaces, it is preferable that one or both of the surfaces have a layer of shock-absorbing material applied thereon to minimize the abruptness and noise of the arrest. In this embodiment, each of the faces 210, 230 has a layer of dense closed-cell rubber foam for this purpose, although other suitable resilient materials can of course be used.

Piston travel can be adjusted in this embodiment by moving the upper attachment 204 relative to the piston 150. The piston 140 includes a central body (e.g., the shaft of the piston 140) and at least two operating holes, representing position selections, near a proximal end of the shaft. Here, three operating holes 400 are illustrated for example, separated by 10 cm. The upper attachment can slide relative to the shaft through a range of positions, and be secured to the shaft at one of the positions. The upper attachment 204 has a tube with a central bore for accommodating the shaft of the piston 150, and also includes a manually acuatable spring-loaded pin mechanism that biases a pin of the upper attachment 204 into one of the operating holes 400 to attach the upper attachment 204 to the piston 150 at a desired location. A control lever 410 on the upper attachment 204 can be used to manually actuate the spring-loaded pin mechanism. It should be understood that other mechanisms and/or methods can be used to provide a selective attachment means, and the invention is not limited to the mechanism disclosed herein.

For securing the piston 150 within the frame when the apparatus is not in use, the piston 150 is also provided with a storage hole 420 similar to the operating holes 400. The location of the storage hole 420 enables the shaft of piston 150 to be secured fully within the apparatus.

While the preferred embodiment provides for adjusting the piston travel, it should be noted that the invention also encompasses embodiments wherein the piston travel cannot be adjusted.

As noted above, the thrust assembly includes at least one tension element, mounted to the carriage assembly and to the piston, impelling the extension and resisting the retraction of the foot. In this regard, the carriage assembly in this embodiment includes the carriage mount 190 to which the lower ends 370 of the tension elements 180 are attached, and the piston 150 includes the piston mount 200 to which the upper ends 350 of the tension elements 180 are attached. Preferably, each tension element 180 is an elastomeric band; however, it should be noted that any suitable form can be used such as, for example, rods, straps and loops. Further, any suitable material can be used, such as rubber, surgical tubing, natural materials or synthetic materials. It should also be noted that many forms of attachment are possible, including, for example, hooks, clips, clamps, angles, stems and catches. The tension force supplied by the tension elements 180 urges the carriage mount 190 toward the piston mount 200, causing the piston 150 to extend away from the carriage assembly. As described above, this extension is limited by the arresting assembly.

Preferably, the tension elements 180 are pre-tensioned. In this embodiment, the arresting assembly effects the pre-tension by setting the minimum operable distance between the carriage mount 190 and the piston mount 200 so that when the piston 150 is fully extended, the tension elements 180 are stretched and therefore in tension. Preferably, the pre-tension force equals the weight of the person. In some embodiments, as will be described in greater detail below, the pre-tension can manually be set for the rider.

The pre-tension of the tension elements 180 permits the adjustment of the piston travel as described above without disengaging the tension elements 180. For example, if the rider desires to adjust the piston travel, the rider can simply rotate the control lever 410 to retract the pin of the upper attachment 204 from an operation hole 400 of the piston 150. Because the tension elements 180 are already held in tension by the arresting assembly and the separation of the ends 350, 370 of the tension elements 180 mandated by the distance between the carriage mount 190 and the piston mount 200 established by the height of the vertical column of the lower insert 110, the piston 150 is free to move relative to the upper attachment 204 without the need to disengage the tension elements 180.

FIGS. 4*a-d*, 5 and 6 illustrate a pogo apparatus which has an adjustable arrest block and which is another embodiment of the invention, in exploded perspective, assembled perspective, and internal views. The illustrated pogo apparatus has many features and elements that are similar in type and function to those described with respect to the preferred embodiment. However, the pogo apparatus of this embodiment features a different arresting assembly and is adapted to allow adjustment of the pre-tension force independently of the adjustment of the piston travel. Therefore, FIGS. 4*a-d* show only the parts of this embodiment that differ from corresponding parts of the preferred embodiment, and the discussion to follow will focus on these alternate features and elements. It is understood that features and elements similar to those described with respect to the preferred embodiment are numbered accordingly but will not be discussed for the sake of brevity. It should also be understood that the discussion of similar elements above applies to this embodiment, as appropriate, as if described fully hereinafter.

Figure 4A:
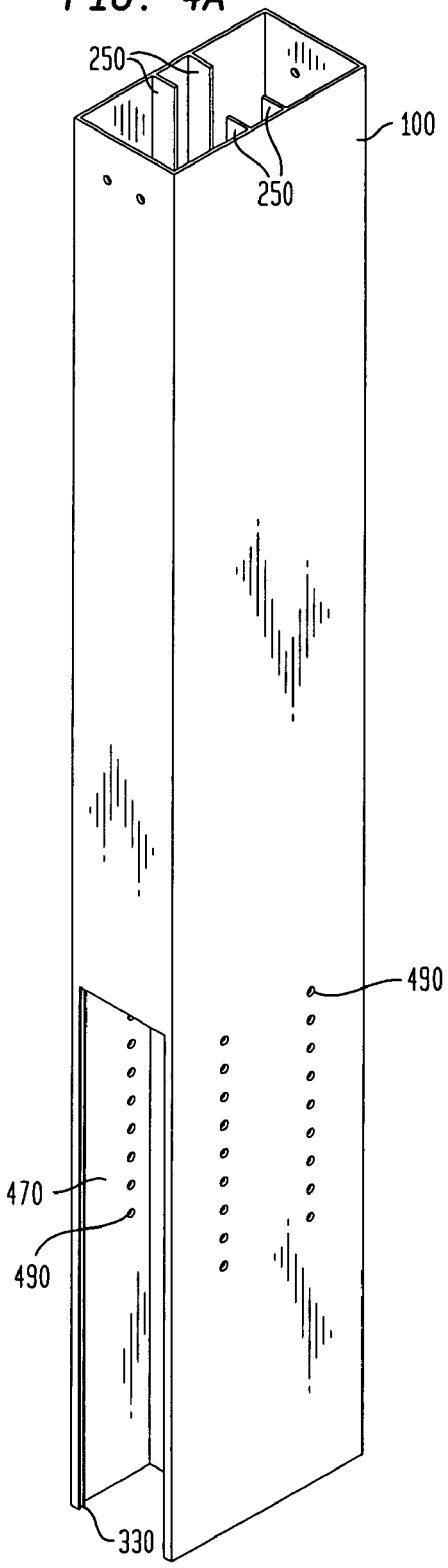
FIGS. 4*a-d* are an exploded perspective view of the parts of the arrest block embodiment that differ from corresponding parts of the preferred embodiment.
Figure 4D:
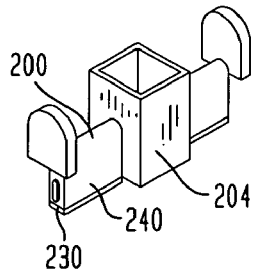
Figure 4C:
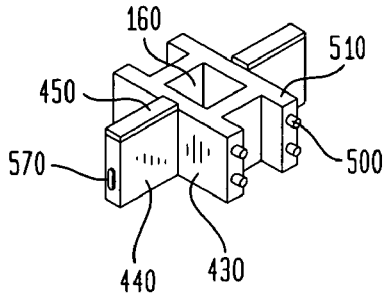
Figure 4B:
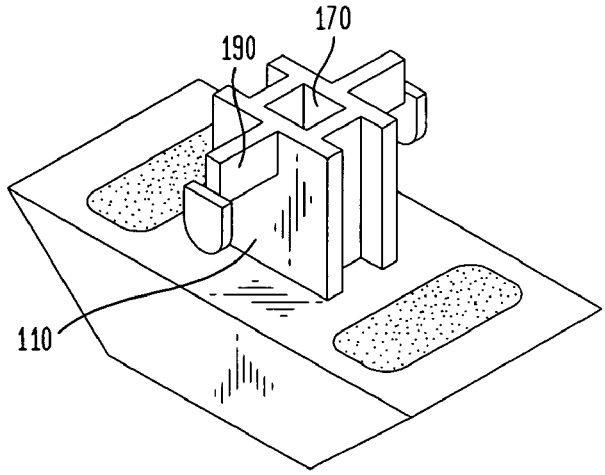
Figure 5:
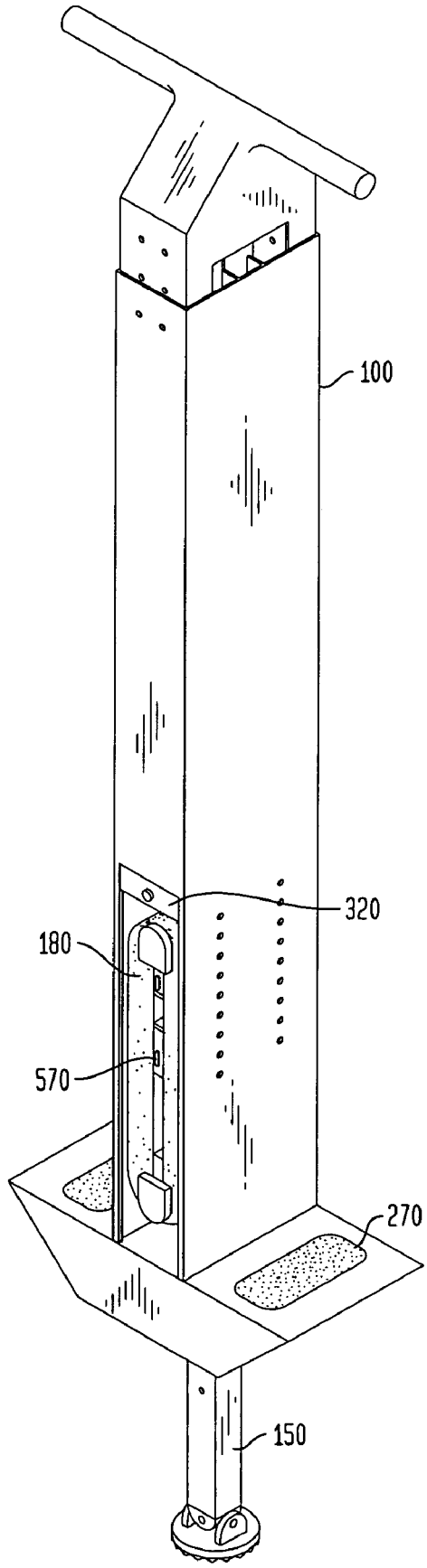
FIG. 5 is an assembled perspective view of the arrest block embodiment.

In this embodiment, the bearing includes an upper bearing 160, shown in FIG. 4*c*, and a lower bearing 170, shown in FIG. 4*b*, for easing the retraction and extension of the piston 150. The lower bearing 170 is provided by the lower insert 110. In this regard, the lower insert 110 includes a vertical column that is, for example, 10 cm high. As will be described in greater detail below, the vertical column of the lower insert in this embodiment can be shorter than the vertical column of the lower insert of the preferred embodiment, because the arresting assembly in this embodiment does not include an upper face of an upper portion of a vane on the vertical column. As in the preferred embodiment, though, the vertical column of this embodiment includes a square tube with a central bore 170, with a bearing surface, that accommodates the piston 150. The column also includes a carriage mount 190 for mounting the lower ends 370 of the tension elements 180. The upper bearing 160 is provided by a carriage assembly feature, in that the carriage assembly feature includes an arrest block 430 that has a square tube with a central bore 160, with a bearing surface, that accommodates the piston 150. The block 430 includes two vanes 440, preferably 7 mm thick, projecting laterally from the front and back faces of the tube, extending from the top of the block 430 to the bottom of the block 430. An upper attachment 204 that can be attached at a distance from a distal end of the piston 150, similar to the upper attachment 204 of the preferred embodiment, provides piston mounts 200 for mounting the upper ends 350 of the tension elements 180.

The arresting assembly in this embodiment includes upper faces 450 of the vanes 440 and lower faces 230 of the lower portion 240 of the piston mount 200. The lower faces 230 of the lower portions 240 contact the upper faces 450 of the vanes 440 to limit the extension of the piston 150 when the arrest block 430 is secured relative to the frame 100 as described below.

Figure 6:
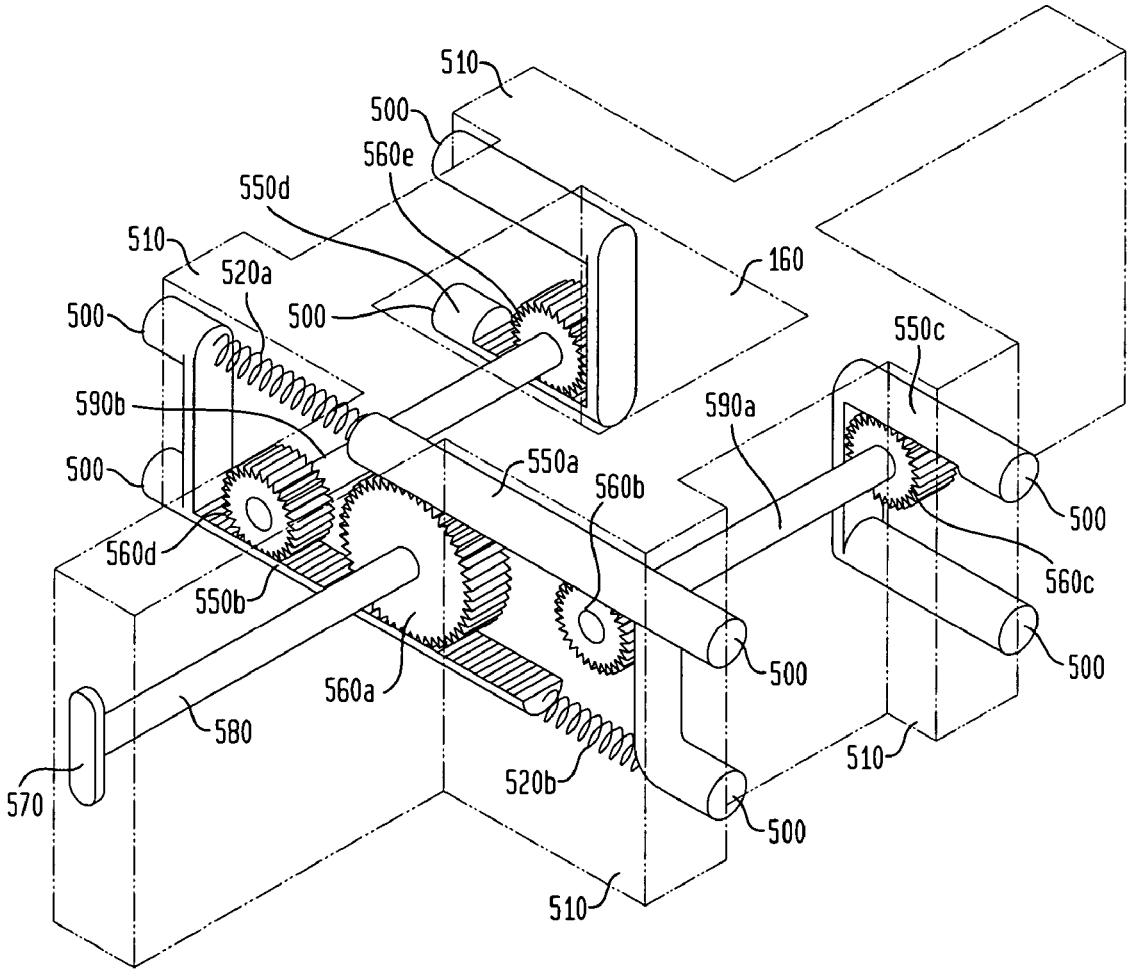
FIG. 6 is a perspective view of an arresting block rack and pinion mechanism of the arrest block embodiment showing an outline of the block in phantom.

The functionality of the arresting assembly will be described with special reference to FIG. 6, which shows the arrest block 430 of FIG. 4*c* with an internal rack and pinion mechanism exposed and the outer surfaces of the arrest block 430 in phantom. The arresting assembly is adjustable in this embodiment. For example, the location of the upper faces 450 of the carriage assembly feature can be adjusted. In this regard, the arrest block 430 can be secured to at least one surface 470 of the carriage assembly by a disengageable attachment mechanism, and slid vertically relative to the surface 470 when the attachment mechanism is disengaged. A suitable disengageable attachment mechanism is, for example, the illustrated rack and pinion mechanism that includes a plurality of spring-loaded pins engaging corresponding holes in the carriage assembly. In this regard, each sidewall of the frame 100 has an inner face 470 that bears a plurality of vertically spaced holes 490. Preferably, the holes 490 extend through the sidewall, for increased stability, as shown. The arrest block 430 fits between the sidewalls and has sides corresponding to the sidewalls. Each side has at least one pin 500 that can be selectively seated within any one of the holes 490 on the corresponding sidewall. The block 430 can be slid vertically relative to the inner face 470 because the upper bearing 160 permits such movement along the shaft of the piston 150 and flanges 510 of the arrest block 430 accommodate the flanges 250 of the frame 100. Preferably, as illustrated, each pin 500 is spring-loaded to bias the pin 500 into one of the holes 490.

The illustrated mechanism includes at least one release for disengaging the pins 500. While any suitable linkage between the pins 500 and the release can be used, the linkage illustrated here includes racks 550*a-d*, attached to the pins 500, that can be moved against the bias of springs 520*a-b* to allow each pin 500 to simultaneously clear its corresponding hole 490. The racks 550*a-d* have teeth that engage the teeth of gears 560*a-e*. The movement of the racks 550*a-d* and gears 560*a-e* is effected by rotation of a rotary lever 570 on a front face of the arrest block 430. The displacement of the panel 320 therefore, in addition to providing immediate access to the tension elements 180, provides immediate access to the lever 570. Preferably, the lever 570 protrudes only minimally to prevent disruption to the retraction and extension of the thrust assembly.

The lever 570 is connected to a drive shaft 580 that rotationally engages a large gear 560*a* that has teeth engaging the teeth on opposing racks 550*a-b* simultaneously. When the lever 570 is rotated counter-clockwise, the large gear 560*a* urges the upper rack 550*a* against the bias of the upper spring 520*a* and urges the lower rack 550*b* against the bias of the lower spring 520*b*. At the same time, the upper rack 550*a* engages an upper forward gear 560*b* that rotationally engages an upper side drive shaft 590*a* that in turn rotationally engages an upper aft gear 560*c* that in turn engages an upper aft rack 550*c*. Similarly, the lower rack 550*b* engages a lower forward gear 560*d* that rotationally engages a lower side drive shaft 590*b* that in turn rotationally engages a lower aft gear 560*e* that in turn engages a lower aft rack 550*d*. Accordingly, the pins 500 retract until the lever 570 is released. When the lever 570 is released (typically after the arrest block 430 has been moved vertically to adjust the location of the carriage assembly feature), the bias of the springs 520*a-b* urges the pins 500 into the holes 490 that are presented to the pins 500. It should be understood that retraction of the pins 500 can be accomplished by other mechanisms, and that the rack and pinion disengageable attachment mechanism set forth herein is one example of a suitable mechanism. Another suitable mechanism would be a ratcheting mechanism wherein a protrusion on the frame can incorporate sleeves around flanges on frame members, permitting the protrusion to slide vertically relative to the frame. In such a mechanism, pawls can be mounted on the sleeves, and corresponding racks can be provided on the flanges. The rider could then apply his or her weight to the apparatus, then reach down and pull the arrest protrusion up as far as possible.

Preferably, the tension element 180 is pre-tensioned. The illustrated embodiment enables the pre-tension to be set according to the weight of the rider. More particularly, the arresting assembly can be adjusted to adjust the pre-tension force. For example, when the rider mounts the pogo apparatus, the piston 150 retracts under the weight of the rider. If the force of the pre-tension is less than the weight of the rider, the lower face 230 of the piston feature 240 will separate from the upper face 450 of the vane 440. The rider may then slide the panel 320 on the track 330 to expose the rotary lever 570, rotate the lever 570 to clear the pins 500 from the holes 490, slide the arrest block 430 upward until the faces 230, 450 are in contact, and then release the lever 570 to allow the pins 500 to seat into corresponding holes 490 at the current height. This establishes a new distance between the carriage mount 190 and the piston mount 200, setting a pre-tension force of the tension element 180 tailored to the weight of the rider.

The primary function of the adjustable arresting assembly is to permit elimination of the pre-tension force, for example, for storage of the apparatus. That is, a lower or lowest set of holes 490 can be provided so that when the arrest block 430 is secured at the height set by those holes, the tension elements 180 are not in tension. This prevents the tension elements 180 from wearing out during storage. At least one set of operating holes above the lowest storage set should be provided. In the illustrated embodiment, multiple sets of operating holes are provided to provide a secondary spring adjustment mechanism as described above. It is preferable, however to primarily adjust the tension force by the engagement and disengagement of spring elements.

Adjustment of the arresting assembly not only sets the pre-tension but also slightly changes piston travel. This effect is, however, insignificant compared to the adjustments which may be affected by the use of the operating holes 400 in conjunction with the attachment mechanism of the upper attachment 204.

FIGS. 7*a-d* and 8 illustrate a pogo apparatus which has an adjustable arresting strap and which is another embodiment of the invention, in exploded perspective and assembled perspective views. The illustrated pogo apparatus has many features and elements that are similar in type and function to those described with respect to the preferred embodiment. However, the pogo apparatus of this embodiment features a different arresting assembly. Therefore, FIGS. 7*a-d* show only the parts of this embodiment that differ from corresponding parts of the preferred embodiment, and the discussion to follow will focus on these alternate features and elements. It is understood that feature and elements similar to those described with respect to the preferred embodiment are numbered accordingly but will not be discussed for the sake of brevity. It should also be understood that the discussion of similar elements above applies to this embodiment, as appropriate, as if described fully hereinafter.

Figure 7A:
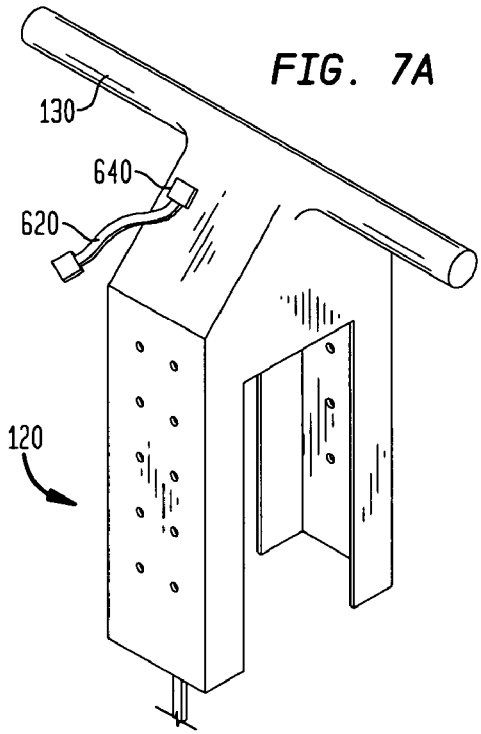
FIGS. 7*a*-7*d* are an exploded perspective view the parts of the arrest strap embodiment that differ from corresponding parts of the preferred embodiment.
Figure 7B:
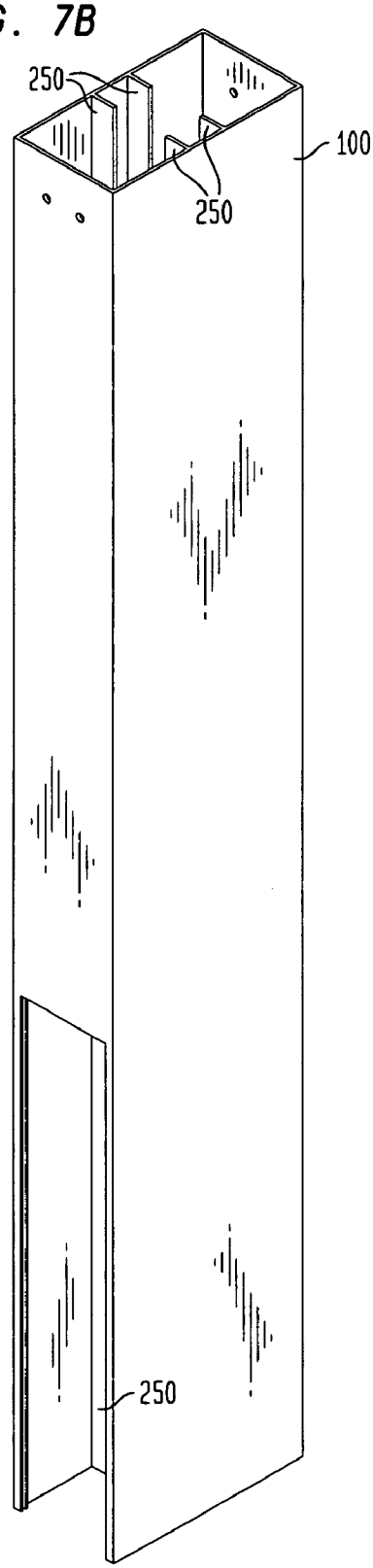
Figure 7D:
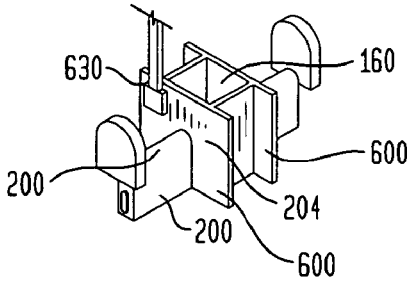
Figure 7C:
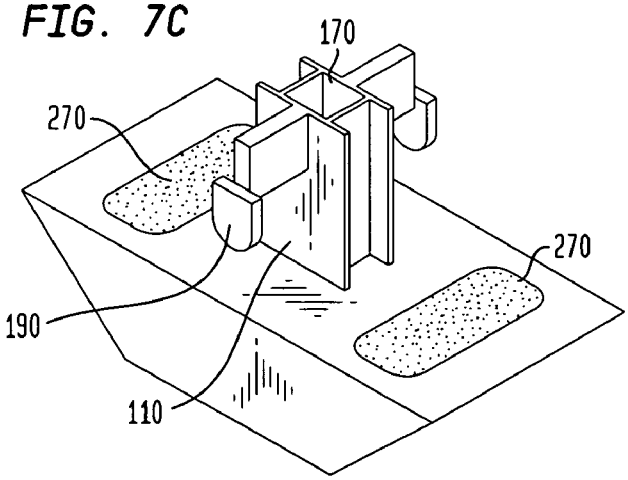
Figure 8:
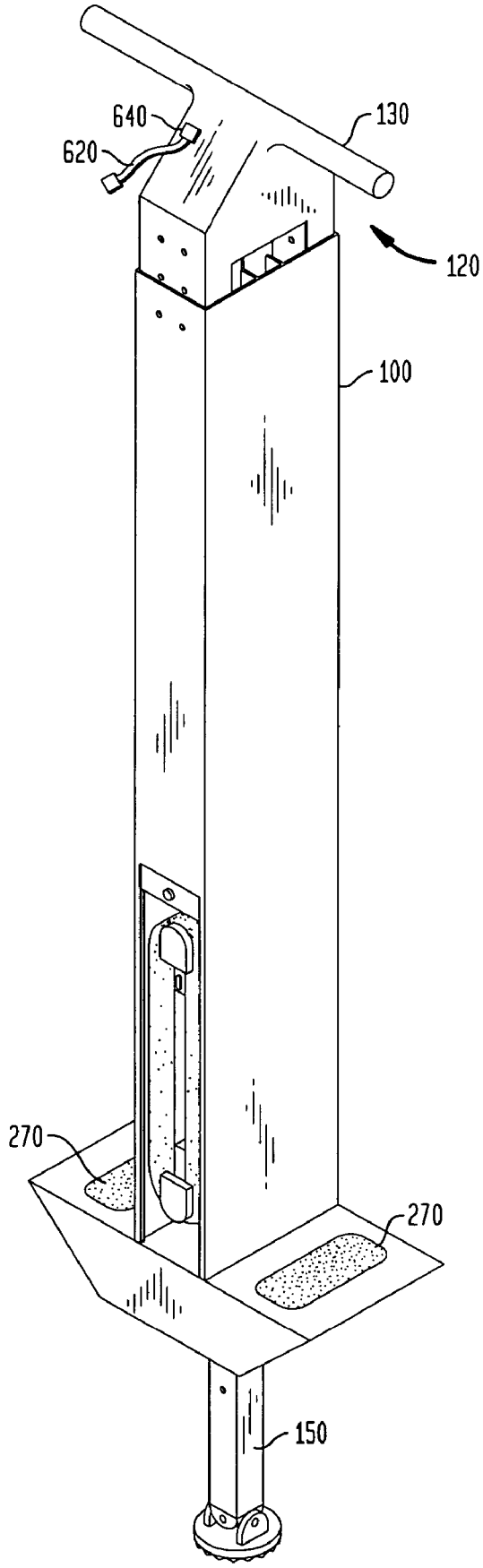
FIG. 8 is an assembled perspective view of the arrest strap embodiment.

In this embodiment, the bearing includes an upper bearing 160, shown in FIG. 7*d*, and a lower bearing 170, shown in FIG. 7*c*, for easing the retraction and extension of the piston 150. The lower bearing 170 is provided by the lower insert 110. In this regard, the lower insert 110 includes a vertical column that is, for example, 10 cm high. As will be described in greater detail below, the vertical column of the lower insert in this embodiment can be shorter than the vertical column of the lower insert of the preferred embodiment, because the arresting assembly in this embodiment does not include an upper face of an upper portion of a vane on the vertical column. As in the preferred embodiment, though, the vertical column of this embodiment includes a square tube with a central bore 170, with a bearing surface, that accommodates the piston 150. The column also includes a carriage mount 190 for mounting the lower ends 370 of the tension elements 180. The upper bearing is provided by the upper attachment 204, inasmuch as the upper attachment 204 in this embodiment includes a sliding bearing as flanges 600 that accommodate the flanges 250 of the frame 100 and that have bearing surfaces to allow the upper attachment 204 to slide relative to the frame 100. The upper attachment 204 is attached at a distance from a distal end of the piston 150 and provides piston mounts 200 for mounting the upper ends 350 of the tension elements 180.

In order to limit the extension of the piston, this embodiment is provided with an arresting assembly that includes a strap 610 of low elasticity having an upper end 620 of its operative length (discussed below) attached to the carriage assembly and a lower end 630 attached to the piston 150. Here, the lower end 630 is attached to the piston 150 inasmuch as the lower end 630 is attached to the upper attachment 204 that is attached to the piston 150. The low elasticity of the strap 610 limits the extension of the piston 150 downwardly away from the carriage assembly. More specifically, the extension of the piston 150 downwardly away from the carriage assembly is limited when the strap 610 becomes taut (reaches the lower limit of its elasticity range). Straps 610 having some elasticity are preferred, so that the arresting of the piston 150 does not jar the rider.

Preferably, an operative length of the strap 610 can be adjusted. The operative length of the strap 610 is that portion which limits the extension of the piston 150 downwardly away from the carriage assembly. In this regard, the carriage assembly can include a spring-loaded cleat 640 through which the strap 610 passes at the upper end 620 of the strap 610. The cleat 640 is spring-biased to clamp the upper end 620 of the strap 610 within the cleat 640 to establish the operative length of the strap 610 between the cleat 640 and the lower end 630 of the strap 610 attached to the upper attachment 204. The bias of the cleat 640 can be temporarily overcome by, for example, manual force to permit the strap 610 to be translated through the cleat 640 to adjust the operative length. Preferably, the cleat 640 is integrated with a portion of the carriage assembly on the handle 130 or near the handle 130, such as, for example, on the telescoping handle assembly 120, so that it can be easily accessed by the rider.

Preferably, the tension element 180 is pre-tensioned. Also preferably, the pre-tension force equals the weight of the person. Such a pre-tension is established in this embodiment if the rider mounts the apparatus when the spring is slack and then pulls the strap 610 taut.

The arresting assembly can also be adjusted to eliminate the pre-tension force, for example, for storage of the apparatus. That is, the rider may step upon the pedal 270 to slacken strap 610 then open cleat 640 and step off the pedal 270. The piston 150 will then extend until the spring becomes relaxed, drawing the strap 610 through the cleat 640, effectively establishing a new operative length of the strap 610. The relaxation of the spring prevents the tension elements 180 from wearing out during storage.

As in the preceding embodiment, pre-tension adjustment slightly affects piston travel. Again, however, piston travel is primarily adjusted by moving the upper attachment 204 on the piston 150 as described above.

Figure 9:
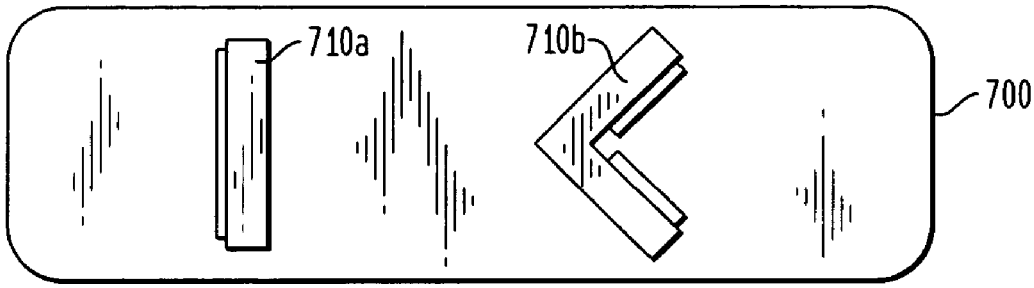
FIG. 9 is a top view of the two-pair scissor-lift embodiment.
Figure 10:
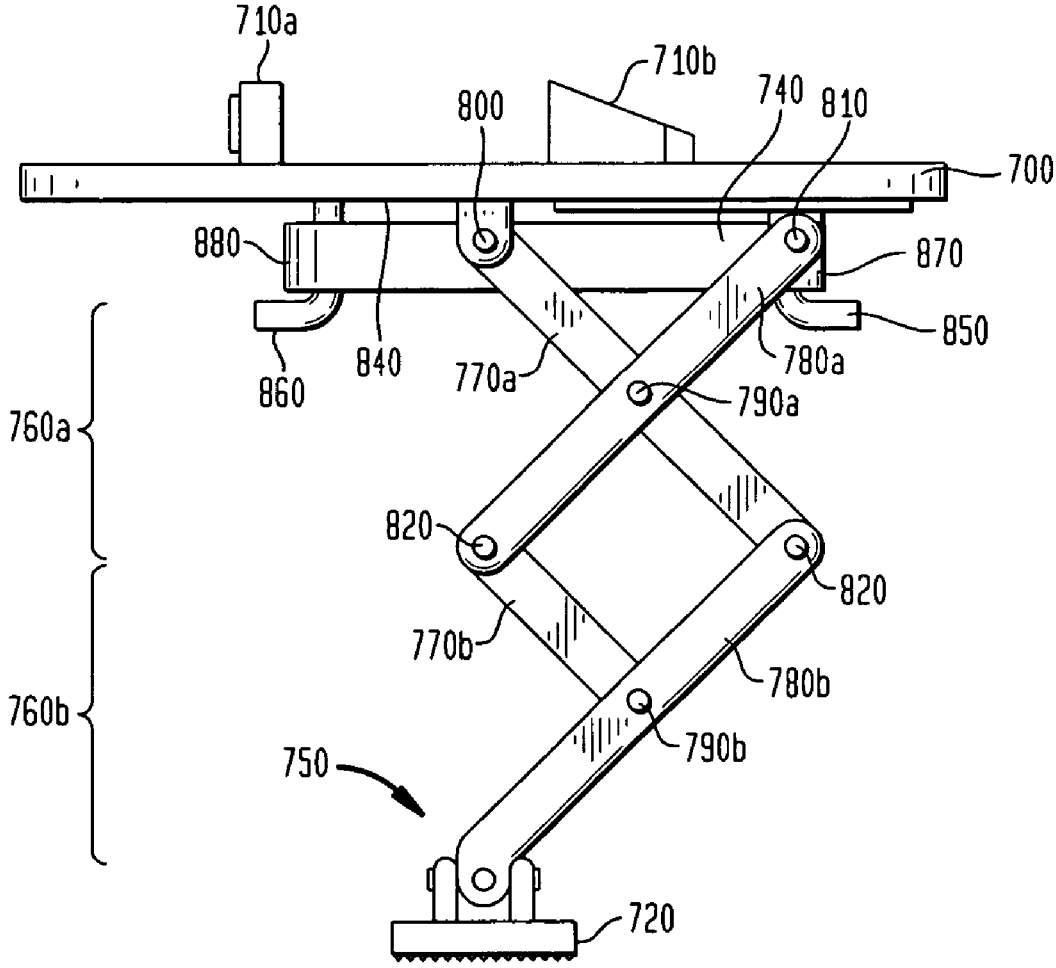
FIG. 10 is a side view of the two-pair scissor-lift embodiment.
Figure 11:
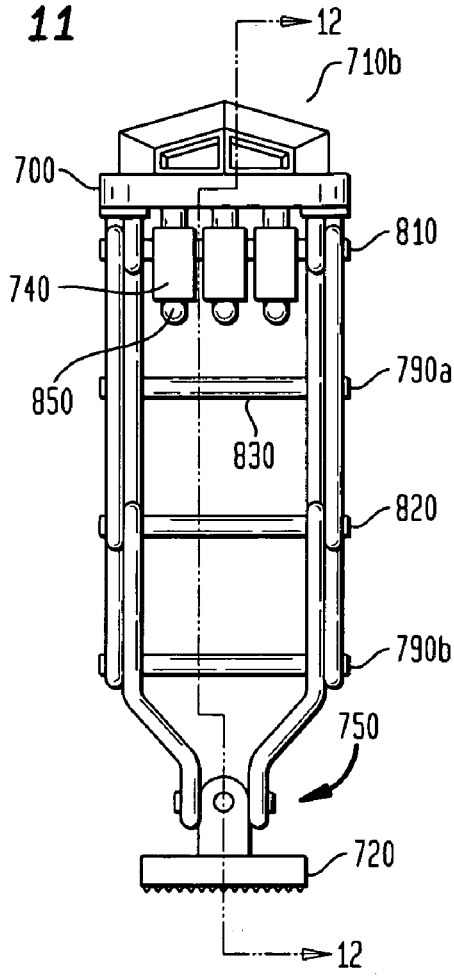
FIG. 11 is a front view of the two-pair scissor-lift embodiment.

FIGS. 9-11 illustrate a scissor-lift bounceboard apparatus as another embodiment of the invention in top, side and front views. The bounceboard apparatus is shown to employ a scalable compound elastomer spring, although other forms of spring such as, for example, coil springs and air springs, could also be used. The illustrated bounceboard apparatus includes a carriage assembly (including a longitudinal platform 700 and at least one control feature 710*a-b*) that can support a rider, a foot 720 alternately retracting toward and extending away from the carriage assembly, and a thrust assembly that has a tension force that impels the extension and resists the retraction. The thrust assembly includes a scissor-lift assembly that is mounted to the carriage assembly and to the foot 720 for enabling the retraction and the extension, and at least one tension element 740 that supplies the tension force for impelling the extension and resisting the retraction.

The platform 700 can support a rider in an upright position. Preferably, the rider's stance on the platform 700 is the stance assumed by a skateboarder on a skateboard, that is, in a standing position with the rider's feet longitudinally separated and with at least one foot transversely oriented. In this position, the length of the rider's back foot gives the rider some degree of roll control, while the separation of the rider's feet affords pitch control.

The carriage assembly further includes the control feature permitting the rider to exercise control over maintenance of contact between the rider's feet and the platform during operation of the apparatus, and to exercise control over direction of the platform during operation of the apparatus. Preferably, the control feature permits the transmission of controlling forces by the rider's feet. For example, the platform could be attached to the rider's feet by stirrups similar to those used on water skis. Or, for example, vertical surfaces projecting from the platform may be provided against which the rider's feet may be pressed to maintain a controlling grip on the apparatus. For example, the rider could obtain a frictional grip permitting an upward pull on the apparatus by exerting opposite forces against the vertical barriers with the rider's two feet, either pinching the feet together or pushing them apart. An advantage of the use of vertical barriers as control features is ease of dismount, inasmuch as the rider need only relax his grip in order to come free from the platform.

Accordingly, in this embodiment, the control feature includes at least one vertical barrier 710*a-b* preventing horizontal motion, in at least one direction, of a foot of the rider. A straight vertical barrier 710*a* is provided, for example, for preventing horizontal motion, in a direction along a long axis of the platform 700, of a left foot of the rider. An angled vertical barrier 710*b* is provided, for example, for encompassing and limiting the horizontal movement of a heel of a front foot of the rider, so that the rider can press his or her front foot against the angled barrier 710*b* toward his or her rear foot, and his or her rear foot against the straight barrier 710*a*, to maintain contact with the platform 700. The angled sections of the angled barrier 710*b* can be engaged by a ball portion of the front foot of the rider to direct the nearest end of the platform 700 in a desired direction. The surfaces of the barriers 710*a-b* that are to be engaged by the rider's feet are preferably provided with a padded gripping material that is comfortable to the rider while helping the rider maintain contact with the barriers 710*a-b*.

As noted above, the bounceboard apparatus includes the scissor-lift assembly, mounted to the carriage assembly and the foot 720, for enabling the retraction and the extension of the foot 720. Preferably, the foot 720 has a relatively large area and is mounted to the scissor-lift assembly with a universal joint 750. While any attachment device can be used, the universal joint 750 allows the scissor-lift assembly to be tilted in any direction without rotating. Similar to the foot of the pogo apparatuses, the large area of the foot 720 permits the bounceboard apparatus to be used on relatively soft surfaces such as, for example, lawns, and affords improved traction on hard surfaces. The ability to tilt the scissor-lift assembly permits the foot 720 to conform to the ground when the shaft is tilted or used on sloping ground. The non-rotation of the foot 720 provides the rider with yaw control and the ability to execute spins.

The scissor-lift assembly includes a vertically ordered set of arm pairs 760*a-b*, with each arm pair 760*a-b* having paired arms 770*a-b*, 780*a-b* joined to one another by a medial hinge 790*a-b* having a horizontal axis. An uppermost arm pair 760*a* of the set can be attached to the carriage assembly by a fixed hinge 800 at a proximal end of one arm 770*a* of the pair and by a sliding hinge 810 at a proximal end of another arm 780*a* of the pair. Any suitable type of hinge can be used. A suitable type of sliding hinge would comprise, for example, knobs sliding in grooves machined into acetal rods affixed to an underside of the platform 700. A lowest arm pair 760*b* has a short arm 770*b* having an operable length terminating at the medial hinge 790*b* and a long arm 780*b* attached at a distal end to the foot 720. The arms are connected so that the foot 720 is beneath the fixed hinge 800; this ensures that the foot 720 is constrained to a linear trajectory normal to the plane of the platform 700.

Figure 12:
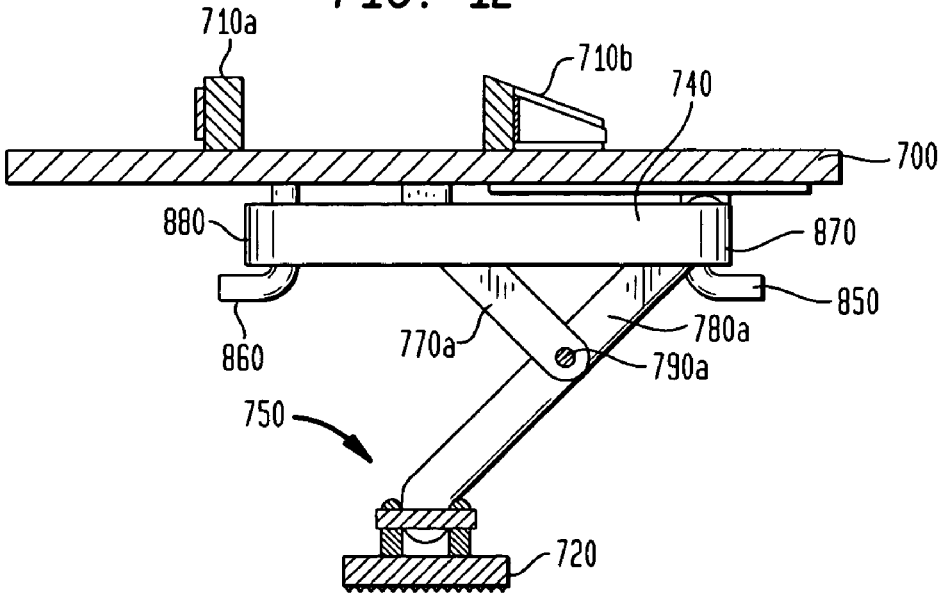
FIG. 12 is a side cutaway view of the one-pair scissor-lift embodiment.

In some embodiments, the scissor-lift assembly includes a plurality of arm pairs in the set, with each arm pair having at least one proximal arm end and at least one distal arm end. Each arm pair can be joined to an adjacent arm pair of the plurality in that the proximal arm end of a lower pair of the joined pairs is attached by at least one hinge to the distal arm end of an upper pair of the joined pairs. For example, FIGS. 9-11 show a bounceboard apparatus as an embodiment of the invention, with a scissor-lift assembly that has two arm pairs 760*a-b* in the vertically ordered set. The lowest arm pair 760*b* is joined to the adjacent uppermost arm pair 760*a* in that the proximal arm ends of the lower pair 760*b* are attached by hinges 820 to distal arm ends of the upper pair 760*a*. It should be understood that other embodiments can use more than two arm pairs in the vertically ordered set, and that other embodiments can use only one arm pair in the vertically ordered set. In the latter embodiments, the uppermost arm pair is therefore also the lowest arm pair. For example, FIG. 12 shows a cutaway view of a bounceboard apparatus as another embodiment of the invention, similar to the embodiment of FIGS. 9-11 except that the scissor-lift assembly includes only one arm pair in the set. It can be seen that this embodiment has many features and elements that are similar in type and function to those described with respect to the embodiment shown in FIGS. 9-11. It is understood that features and elements similar to those described with respect to that embodiment are numbered accordingly in FIG. 12 but will not be discussed for the sake of brevity. It should also be understood that the discussion of similar elements with respect to the embodiment of FIGS. 9-11 applies to this embodiment, as appropriate, as if described fully in accordance herewith.

Whether the set includes one arm pair or a plurality of arm pairs, it should be noted that in many applications, the arms will require structural depth transverse to the axis of the carriage assembly. Preferably, and most efficiently, this depth can be provided by compound beams. For example, multiple sets can be mounted in parallel to one another and connected laterally by crossmembers serving as chords of the compound beam. More specifically, for another example, the parallel sets can be separated by, for example, a few inches, and corresponding arms of the set can be connected by crossmembers serving as the web of the resulting compound beam. Accordingly, as best seen in FIG. 11, the illustrated scissor-lift assembly includes two vertically ordered sets of arm pairs connecting the carriage assembly and the foot 720. The sets are connected in parallel to one another by at least one crossmember 830 connecting corresponding arms of the sets in parallel. It should be noted that when compound beams are used, it may be necessary, as illustrated for example, to taper the arms of the lowest arm pairs to center the foot 720 underneath the platform 700 for maintaining proper balance during use of the apparatus.

As noted above, the thrust assembly includes at least one tension element 740 that supplies the tension force for impelling the extension and resisting the retraction. The tension element 740 may be connected between any locations on the apparatus that approach each other during extension of the foot 720. For example, the hinges attaching the proximal and distal arm ends of adjacent arm pairs would provide useful locations, especially if the hinges are at the same height. Additionally or alternatively, for example, crossmembers of a compound beam would provide useful locations, especially if the crossmembers are at the same height. Additionally or alternatively, for example, one location could be a proximal end of one of the arms, and/or a crossmember between proximal ends of the arms (if a compound beam configuration is used), adjacent the sliding hinge 810 on the carriage assembly, and the other location could be a mount on the carriage assembly that is fixed relative to the sliding hinge 810 and beyond the fixed hinge 800.

Accordingly, in the illustrated embodiment, a plurality of tension elements 740 are attached at one end to the carriage assembly and at another end to the crossmember 830. In order for the tension elements 740 to impel the extension and resist the retraction as required, they must be mounted to bias the sliding hinge 810 toward the fixed hinge 800. In this regard, the carriage assembly has a bottom surface 840, from which at least one fixed mount 850 depends. At least one corresponding sliding mount 860 depends from the crossmember 830. The tension elements 740 are attached at one end to the fixed mount 850 and at another end to the sliding mount 860, so that the tension force of the tension elements 740 will bias the sliding mount 860 (and with it the sliding hinge 810) toward the fixed mount 850 (and therefore toward the fixed hinge 800).

The illustrated embodiment includes an access feature that enables the engagement and disengagement of the tension elements 740. The access feature includes the fixed mount 850 and the sliding mount 860, inasmuch as each of the mounts 850, 860 has an opening through which an end of the tension elements 740 can be passed. That is, when the tension elements 740 are mounted, they are not enclosed by either mount 850, 860. More specifically, front ends 870 of the tension elements 740 are mounted to the sliding mount 860 by passing loops of the front ends 870 over an angled portion on the sliding mount 850. Similarly, back ends 880 of the tension elements 740 are mounted to the fixed mount 840 by passing loops of the back ends 880 over an angled portion on the fixed mount 880. The angled portions prevent the tension elements 740 from slipping off the mounts 850, 860. In this regard, each tension element 740 is individually mountable and demountable. The rider can therefore reduce the tension force by removing (manually disengaging) at least one tension element 740. Similarly, the rider can increase the tension force by adding (manually engaging) another tension element 740, or replacing a previously removed (previously manually disengaged) tension element 740.

The illustrated embodiments include a shield member that protects the rider from contact with at least one moving part of the thrust assembly. In these embodiments, the platform 700 operates as such a shield member, inasmuch as the scissor-lift assembly 730 is mounted to a bottom surface of the platform 700, and retracts and extends underneath the platform 700.

Other embodiments of the invention that include scissor-lift assemblies can include a carriage assembly that includes a vertically extending support structure; at least one handle, on the support structure, that can be grasped by the person; and at least one pedal, on the support structure, on which the person can stand. In this manner, the invention encompasses a scissor-lift pogo apparatus. For example, a carriage assembly can include a primary structural frame as the vertically extending support structure, and a telescoping handle assembly received by a top of the frame and having a handle that can be grasped by the rider. A lower portion of the frame can have pedals. For example, these components can be similar or identical to the corresponding components described above and illustrated with respect to the preferred embodiment. However, instead of a piston 150, the thrust assembly in this scissor-lift pogo apparatus could include a scissor-lift assembly mounted between the foot 140 and a bottom surface of the frame 100. The scissor-lift assembly could be any suitable type, including but not limited to the types employed by the scissor-lift apparatuses discussed and illustrated above. In such an embodiment, the scissor-lift assembly is part of a thrust assembly and the invention provides a bouncing apparatus having the pedal platform as a shield member that protects the rider from contact with at least one moving part of the thrust assembly. Mounts on the bottom surface of the frame 100, such as, for example, angled portions similar to the angled portions of the fixed and sliding mounts 850, 860 discussed above, could have openings through which an end of the tension element can be passed, and therefore provide an access feature enabling engagement and disengagement of the tension element.

Still other embodiments of the invention can overcome a vertical piston travel limit imposed by a comfortable height (for most rider sizes) of the carriage assembly. A compound apparatus could be constructed to use a plurality of tension assemblies of the types discussed herein in series, in order to achieve greater effective piston travel and higher bounces. For example, while certain embodiments of the invention, such as the pogo apparatus discussed above, has a piston travel of approximately 2 feet (imposed by the frame height), a compound apparatus using, for example, three telescoping tubes and two compound tension assemblies connected in series, can achieve an effective piston travel of 3 to 4 feet, and thus be capable of bounces having heights of between 12 and 15 feet.

Still other embodiments can include a variable reel gain system, wherein the tension element, or a plurality of tension elements, are attached at their top ends to a frame, and at their bottom ends to a strap of low elasticity which winds onto a reel affixed near a lower end of the frame. A second strap simultaneously winds off the same reel, and is affixed at an upper end to a piston. Consequently, retraction of the piston causes extension of the tension elements, with a mechanical gain that can be varied through the course of the piston stroke by varying the diameter of one or both sides of the reel (the reel thus resembling a screw with an inconstant thread depth). The benefit of such a system would be to permit the use of any desired resistance function. For example, it would be possible to maintain spring resistance at the maximum comfortable level throughout the piston travel. This can increase the operational ceiling of the device. Such a variable reel gain system can be used with any embodiment of the invention, including the embodiments discussed specifically herein.

Figure 1E:
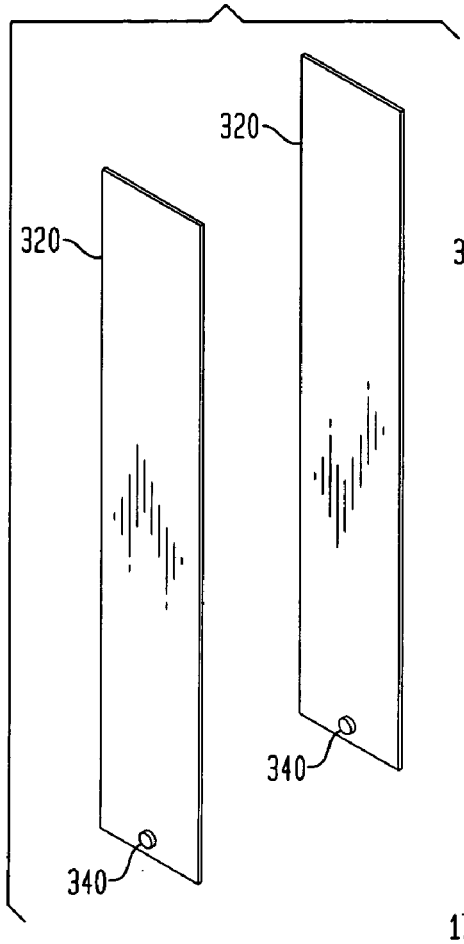
Figure 1G:
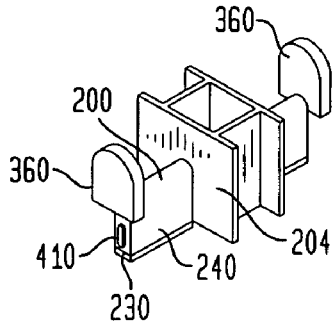
Figure 1F:
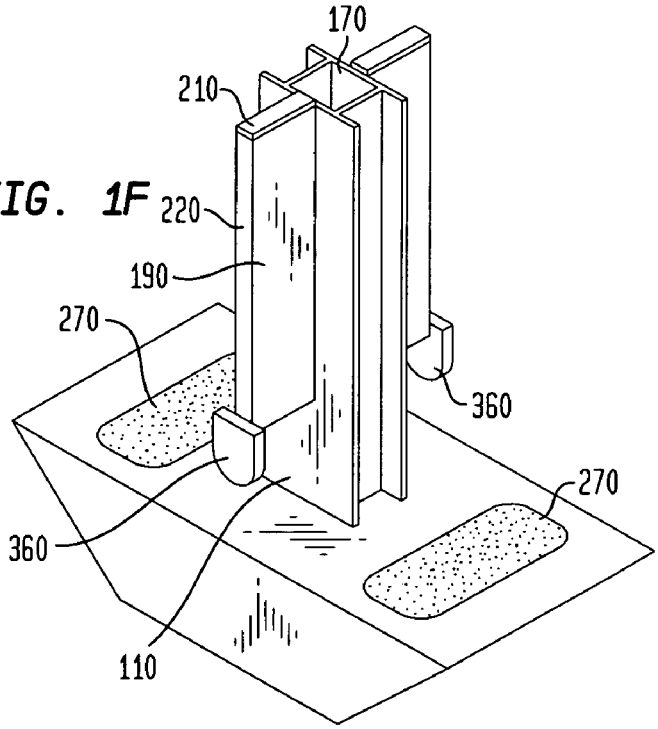
Figure 2:
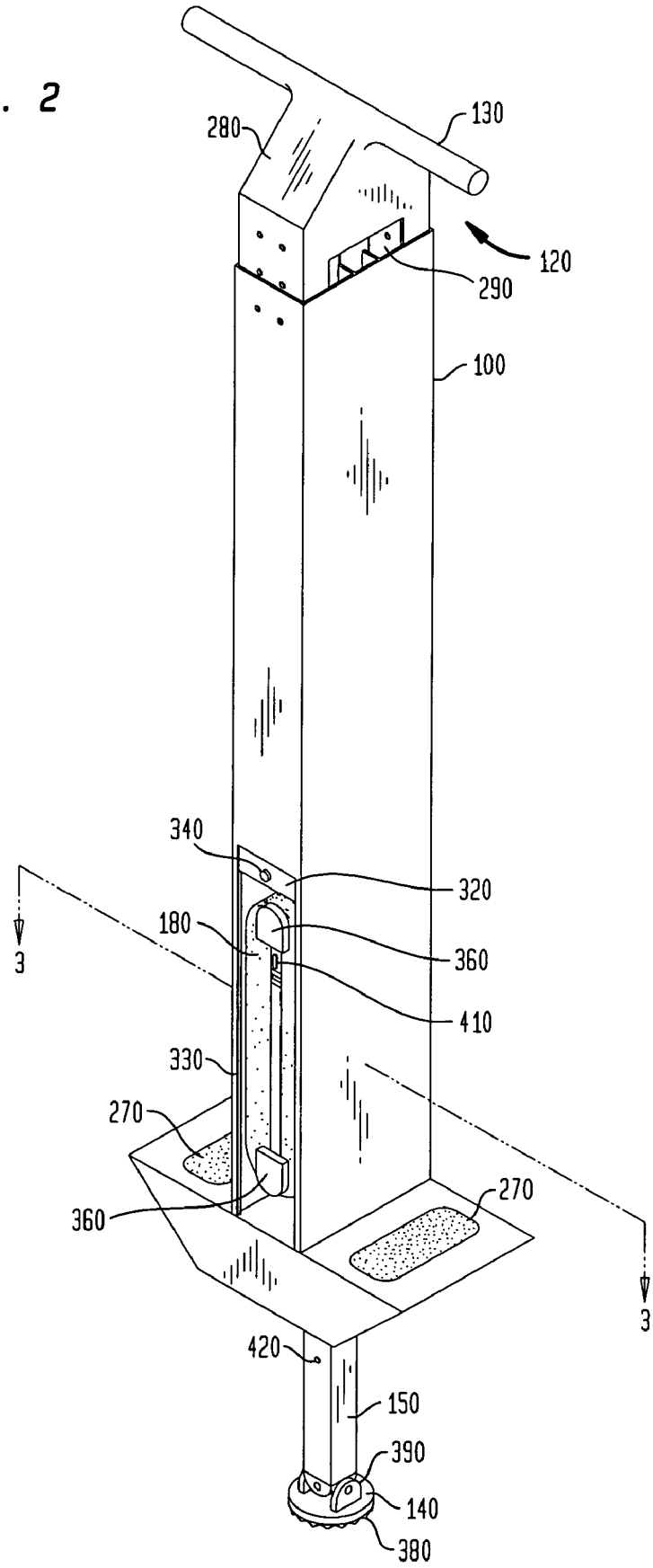
FIG. 2 is an assembled perspective view of the preferred embodiment.
Figure 3:
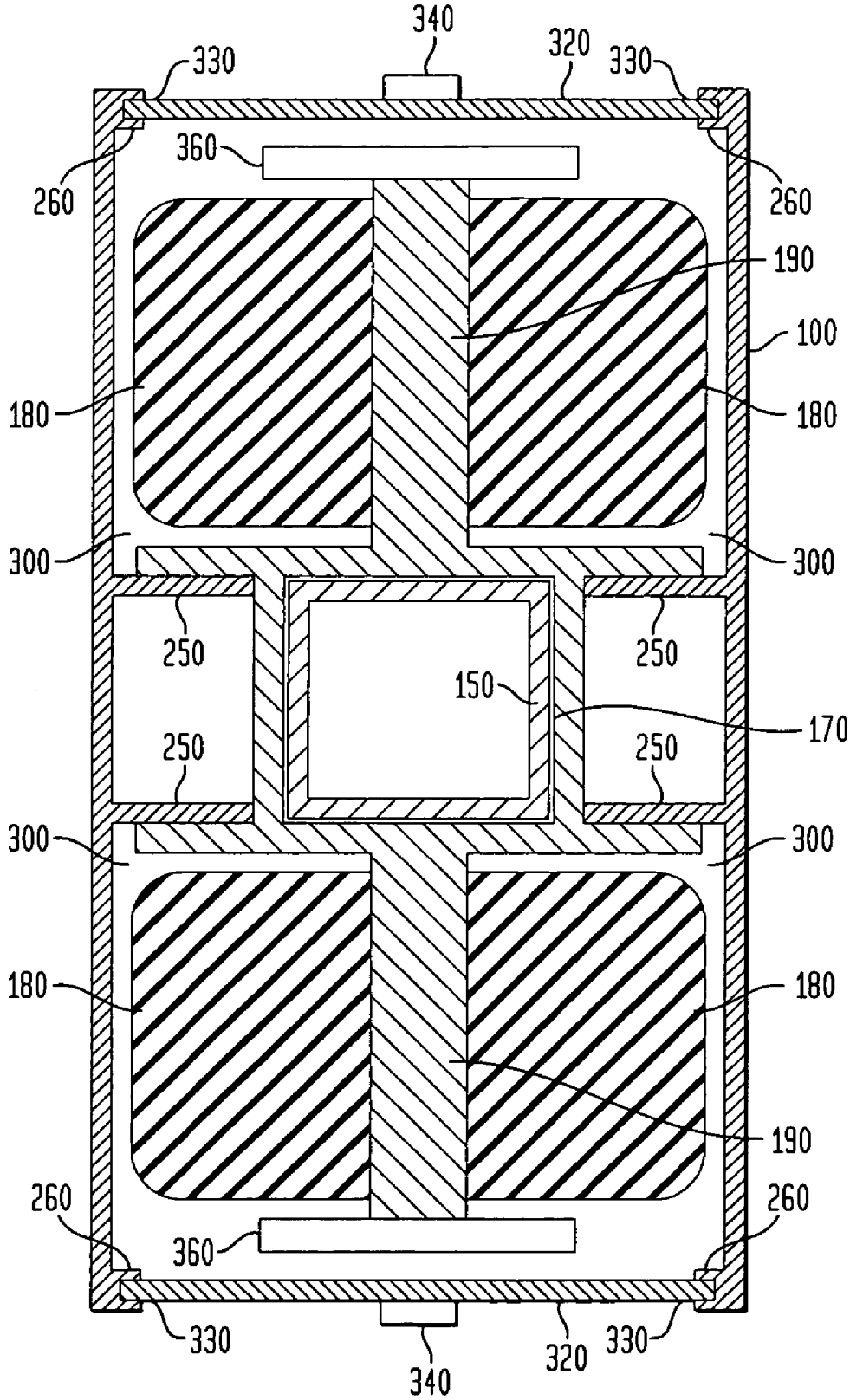
FIG. 3 is a cutaway view of the preferred embodiment as indicated in FIG. 2.
Figure 22A:
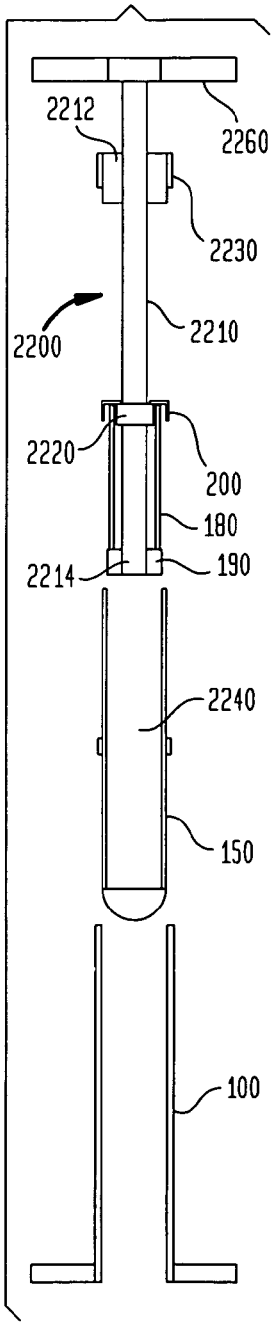
FIGS. 22*a-c* illustrate an example of a cartridge unit spring-in piston embodiment of the present invention.
Figure 22B:
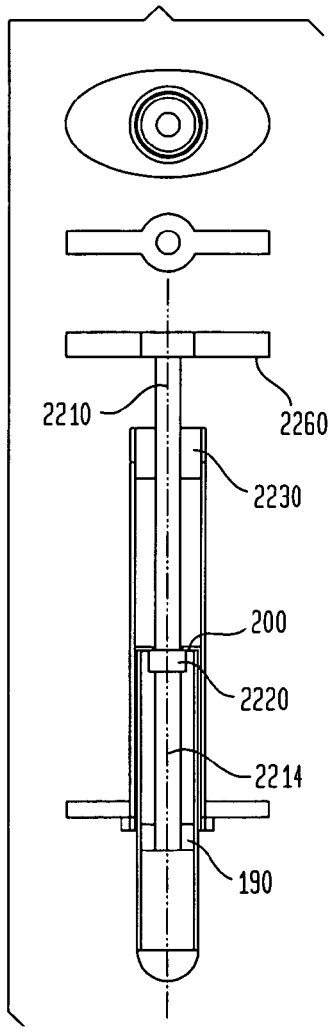
Figure 22C:
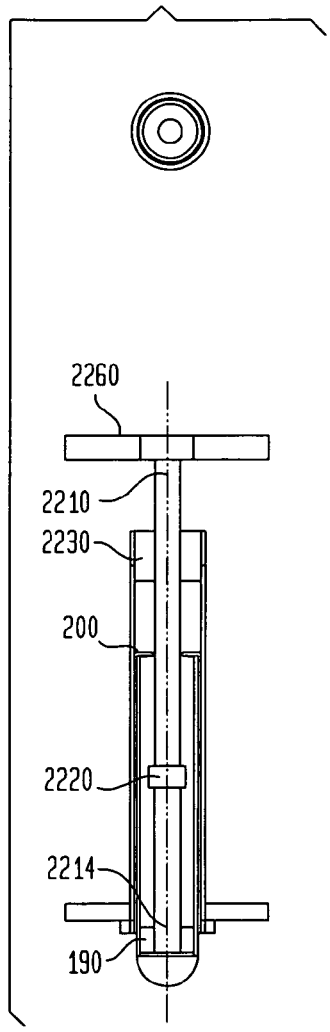

FIGS. 22*a-c* illustrate another embodiment of the present invention comprising a cartridge-type system that provides convenient access to the tension element(s) 180. A cartridge unit 2200 preferably includes the tension element 180, the upper mount 200 and the lower mount 190. The cartridge unit optionally includes a grip 2260 for use as a handle. The cartridge unit may be removed intact from the frame 100 to permit adjustment, e.g., engaging or disengaging one or more of the tension elements 180. The cartridge unit 2200 may be removed from the top or bottom of the frame 100, or from an access feature such as the panel 320 (FIG. 1*e*). In one example, the cartridge unit 2200 includes the piston 150 and may be removed from the bottom of the frame 100. The cartridge unit 2200 may be conveniently reinserted into the frame 100 in like manner.

As shown in FIGS. 22*a-c*, the cartridge unit 2200 preferably also includes a cap 2230 and a strut 2210 in a "spring-in piston" configuration. The cap 2230 covers an opening at the top end of the frame 100. The strut 2210 projects into the piston 150 and supports the lower mount 190. The strut 2210 acts as a central support member. The strut 2210 is preferably co-axial with the piston 150. The strut 2210 has an upper section 2212 attached to a lower surface of the cap 2230 and a lower section 2214 which extends into a central cavity 2240 of the piston 150. The tension element 180 is attached at the bottom to the lower section 2214 of the strut 2210 and at the top to the upper mount 200 that is engaged by the upper end of the piston 150. Thus, the tension element 180 is situated at least partly within the piston 150 during at least part of the piston stroke.

In the example of FIG. 22, the tension element 180 is preferably contained within the piston 150. This configuration may necessitate the piston 150 being of a relatively large diameter, e.g., a few centimeters smaller than the interior diameter of the frame 100. A benefit of such a diameter is enhanced piston strength, which may permit the piston 150 to comprise a lightweight and/or cost effective material such as plastic. When the cartridge unit 2200 is installed in the frame 100, the upper mount 200 preferably engages an upper part of the piston 150 so that retraction of the piston 150 stretches the tension element 180. When the cartridge unit 2200 is removed from the frame 100, a stop 2220 on the strut 2210 corresponds to full extension of the piston 150. Thus, pretension of the tension element 180 is maintained, and the cartridge unit 2200 may be reinserted into the frame 100 without encountering undue resistance from the tension element 180.

Figure 23A:
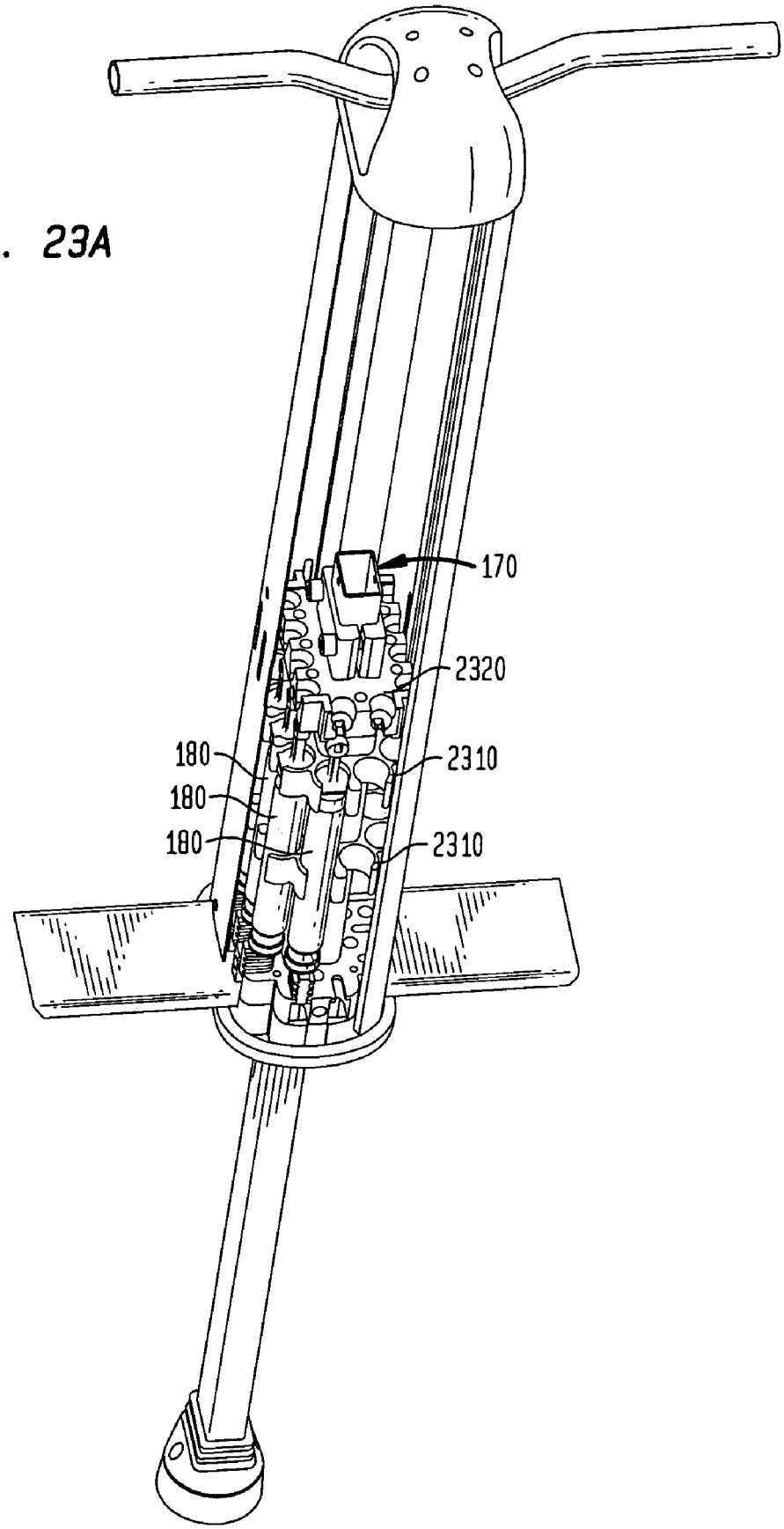
FIGS. 23*a-c* are cutaway views illustrating semi-mounted internal storage in accordance with aspects of the present invention.
Figure 23B:
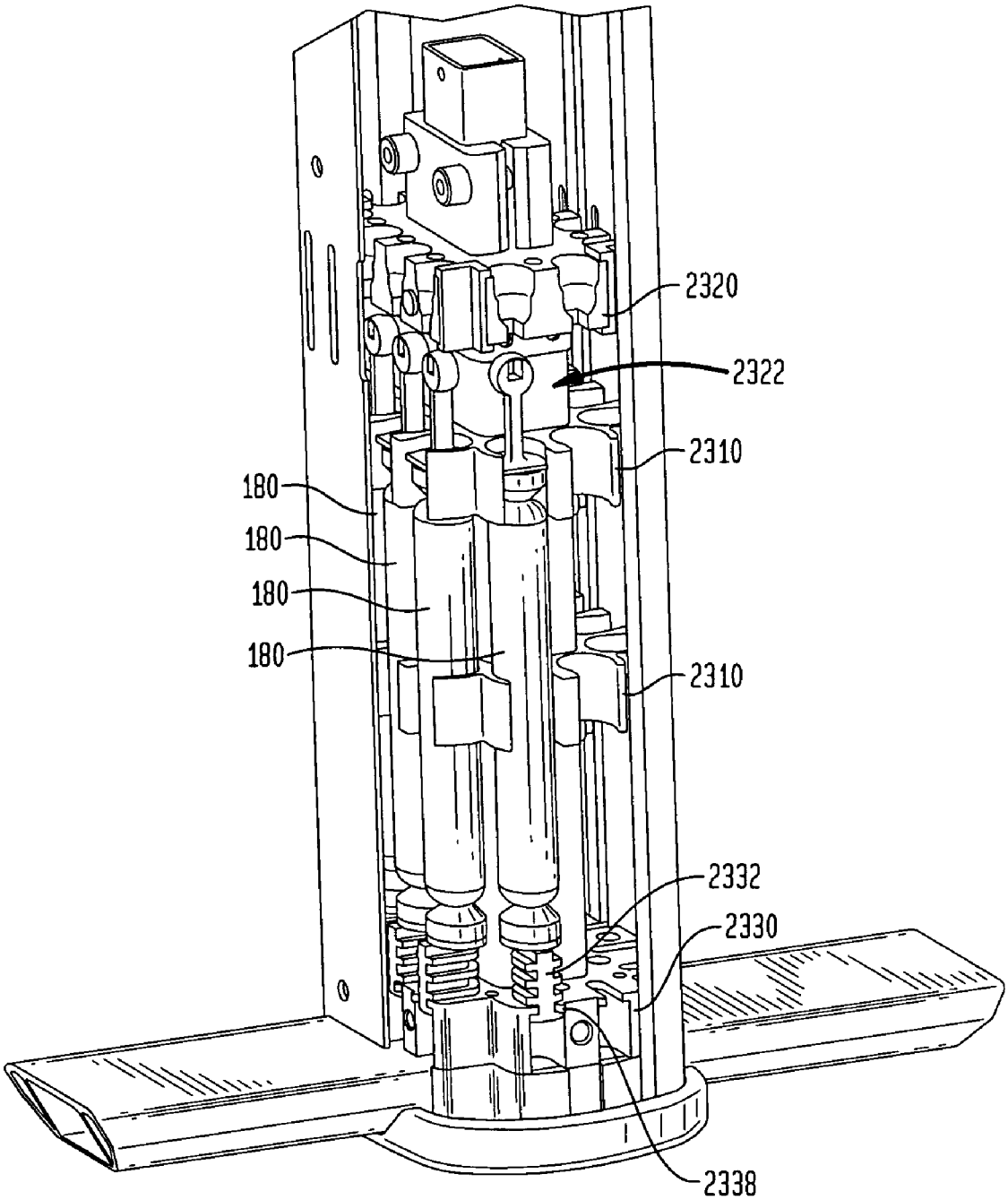
Figure 23C:
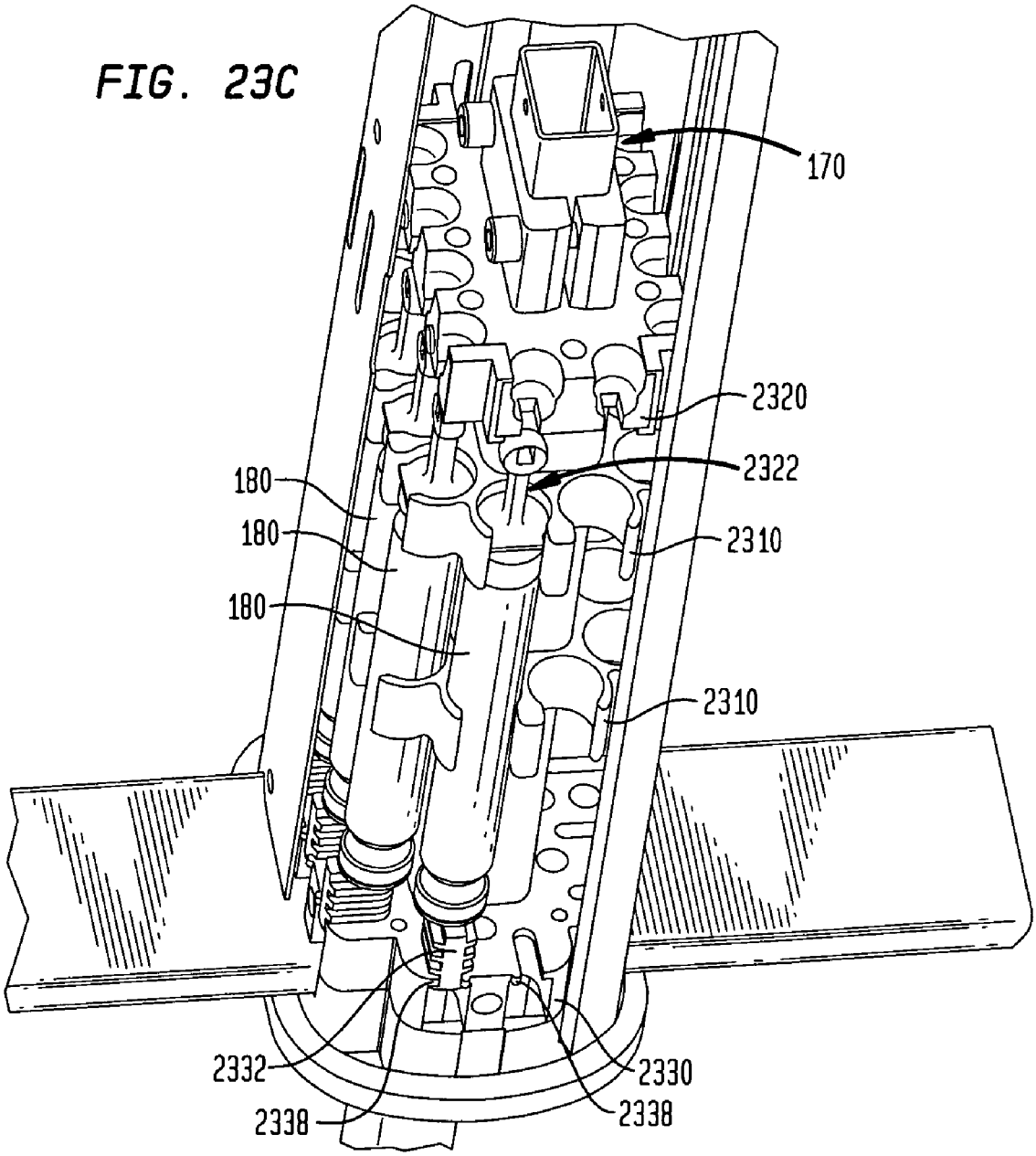

FIGS. 23(*a*)-(*c*) illustrate features in accordance with further aspects of the present invention. FIG. 23(*a*) is a full cutaway view of a bouncing apparatus showing internally demounted tension elements 180. FIGS. 23(*b*) and 23(*c*) are enlarged cutaway views of the bouncing apparatus. As shown in FIGS. 23(*a*)-(*c*), the tension elements 180 may be, e.g., tubular or rod-shaped. In a preferred example, the tension elements 180 are of a solid tubular design. In another preferred example, the tension elements 180 are hollow, dip-formed tubing. In a case where hollow tubing is used, the interior hollow channel desirably has a small diameter of about 1/16 of an inch. In another example, the tension elements 180 are six inches long. In yet another example, the tension elements 180 are between three and twelve inches in length. The tension elements 180 may be rubber tubing or an elastomeric rod having a diameter less than one inch. In one example, the rod/tubing has a diameter of between about 0.8 to 0.875 inches. In another example, the diameter is on the order of 0.75 inches or less. In yet another example, the diameter is on the order of 0.5 inches. Other shapes and/or configurations of the tension elements 180 may also be used. For example, if the tension elements 180 are extruded, they can be rectangular or have any cross-sectional shape. The length and other parameters of the tension elements 180 may also be selected depending upon various factors related to the bouncing apparatus, including the dimensions of the bouncing apparatus components, the tension desired, cost, etc.

As seen in the figures, when demounted, a top end of the tension element 180 is below an upper mount 2320. In this situation, the clearance between the top end and the base of the upper mount 2320 may be small, for example, about ¼ inch. When fully mounted, the top end of the tension element 180 engages the upper mount 2320 by means of an upper hanger mechanism 2322. A bottom end of the tension element 180 may engage a lower mount 2330 by means of a lower hanger mechanism 2332.

As discussed above, there are several important issues related to internal storage, connection and tension element operation that should be addressed in order to achieve robust and long-lasting performance from the bouncing apparatus. Creeping and overstretching of the tension elements 180 can have deleterious results. By way of example only, depending upon the dimensions and spacing of the components, if a tension element 180 creeps or is overstretched, it is possible that the upper hanger mechanism 2322 may not properly engage the upper mount 2320, or may require excessive force in order to connect to the upper mount 2320. In the former case, the tension element 180 might become demounted, changing the tension force of the bouncing apparatus. The end result is that problems with the tension element 180 may ultimately the performance of the apparatus.

Preferably, the tension elements 180 are comprised of rubber. However, as previously mentioned, elastomeric materials including rubber are subject to creeping. There are many different types of rubber that can be employed. When selecting the rubber, resilience and longevity are preferred over stiffness. In one preferred example, unfilled natural rubber (rubber without fillers such as clay or carbon black) is used. In another preferred example, synthetic polyisoprene is used.

Even if a material is chosen that is resistant to creeping or overstretching, these effects should still be taken into account. One option is, of course, to discard fatigued tension elements 180 and replace them with new ones. Unfortunately, the replacement cost must be factored in as well. Therefore, it is less desirable to replace the tension elements 180 and more desirable to be able to re-tension the old tension elements 180.

Figure 24A:
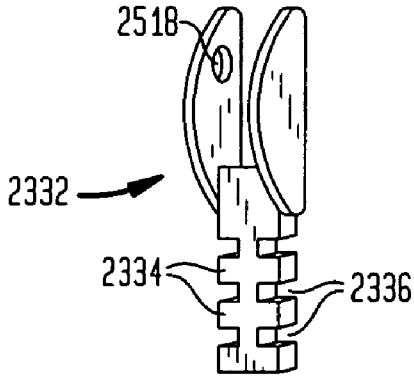
FIGS. 24*a-b* illustrate adjustable hangers in accordance with aspects of the present invention.
Figure 24B:
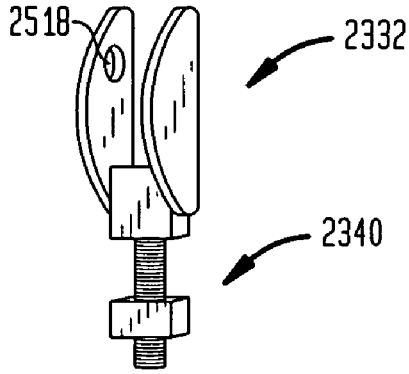

It has been discovered that an adjustment mechanism may be employed to effectively re-set the tension for mounted tension elements. FIGS. 24(*a*) and 24(*b*) illustrate lower hanger mechanisms 2332 that are adjustable. As seen in FIG. 24(*a*), the lower hanger mechanism 2332 preferably includes one or more extensions 2334, which have adjacent grooves 2336. The extensions 2334 may be formed easily and inexpensively as part of the lower hanger mechanism 2332 by, e.g., molding. As best seen in FIGS. 23(*b*) and 23(*c*), the lower mount 2330 preferably includes lips or protrusions 2338. The lower hanger mechanism 2332 can be adjusted down so that the next groove 2336 engages the lip 2338. This removes the slack and re-sets the tension to about what it would have been absent creeping or overstretching. In a preferred embodiment, the extensions 2334 and grooves 2336 are dimensioned so that the slack may be taken up in increments of ¼ inch or smaller. In another preferred embodiment, the extensions 2334 and grooves 2336 are dimensioned so that the slack may be taken up in increments greater than ¼ inch. In a further preferred embodiment, there are a suitable number of extensions 2334 and grooves 2336 to compensate for up to a 10% elongation of the tension element 180. In yet another preferred embodiment, there are a suitable number of extensions 2334 and grooves 2336 to compensate for up to a 25% elongation. In a further embodiment, the extensions 2334 and grooves 2336 provide between two (2) and ten (10) levels of adjustment. More preferably, there are approximately four (4) levels of adjustment. In an alternative embodiment shown by FIG. 24(*b*), a screw-like mechanism 2340, such as a threaded rod, may be employed to take up the slack. The bottom of the screw-like mechanism 2340 may be connected to the lower mount 2330, and as the screw mechanism is rotated, the slack is taken up. In this case, the slack may be adjusted incrementally by the user, providing enhanced flexibility. While the alternatives illustrated in FIGS. 24(*a*) and 24(*b*) are preferred, it is possible to use other devices and methods to take up the slack. The upper and lower hanger mechanism 2322, 2332 are preferably made of metal, plastic or both, although other materials having similar properties may be used.

Another issue mentioned earlier relates to attaching the upper and lower hanger mechanisms 2322, 2332 to the tension element 180. In conventional devices, a hanger may be attached to rubber tubing by inserting a hanger stem with a knob on the end into the tubing, and then cinching the rubber above the knob. Unfortunately, tests have shown that after prolonged use, the rubber around the hanger component tends to fail. A system and method have been discovered which mitigates this problem.

Figure 25A:
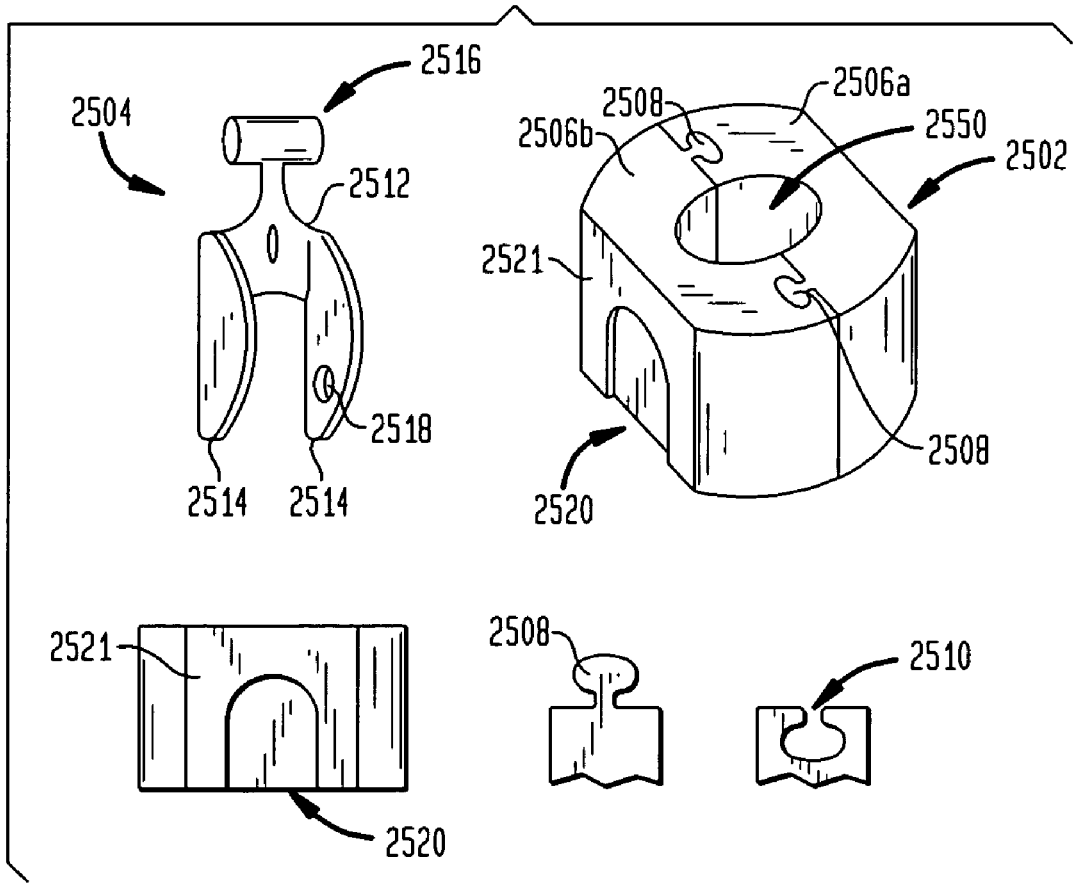
FIGS. 25*a-c* illustrate collars and hangers for tension elements in accordance with aspects of the present invention.
Figure 25B:
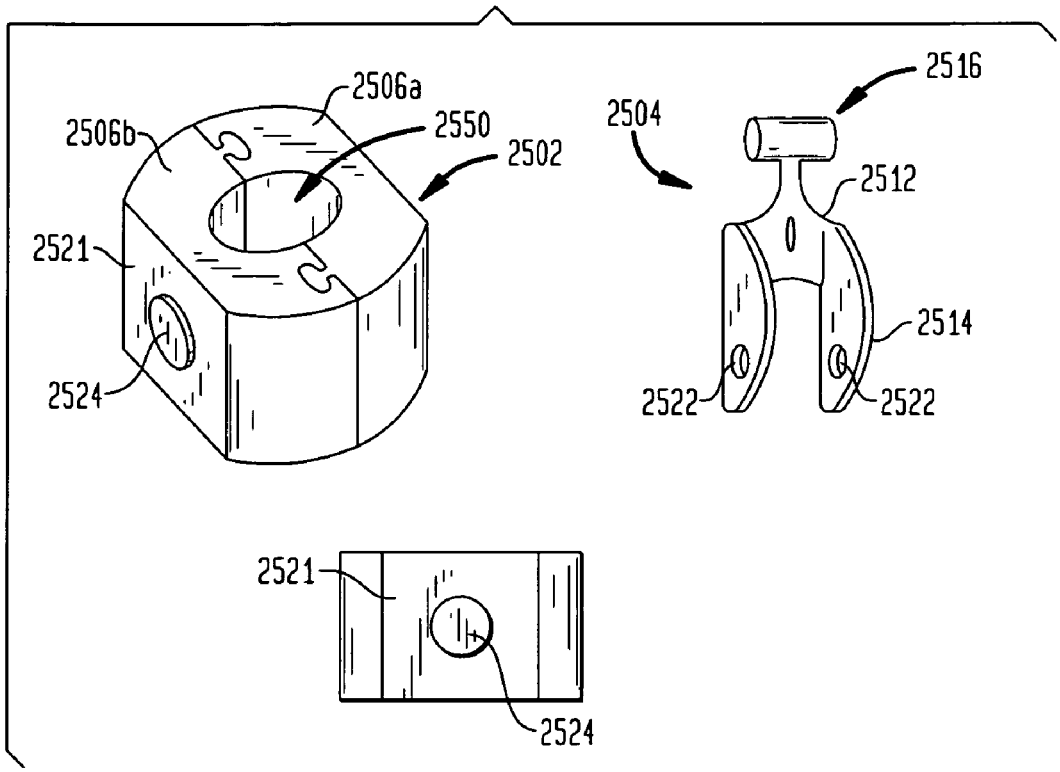
Figure 25C:
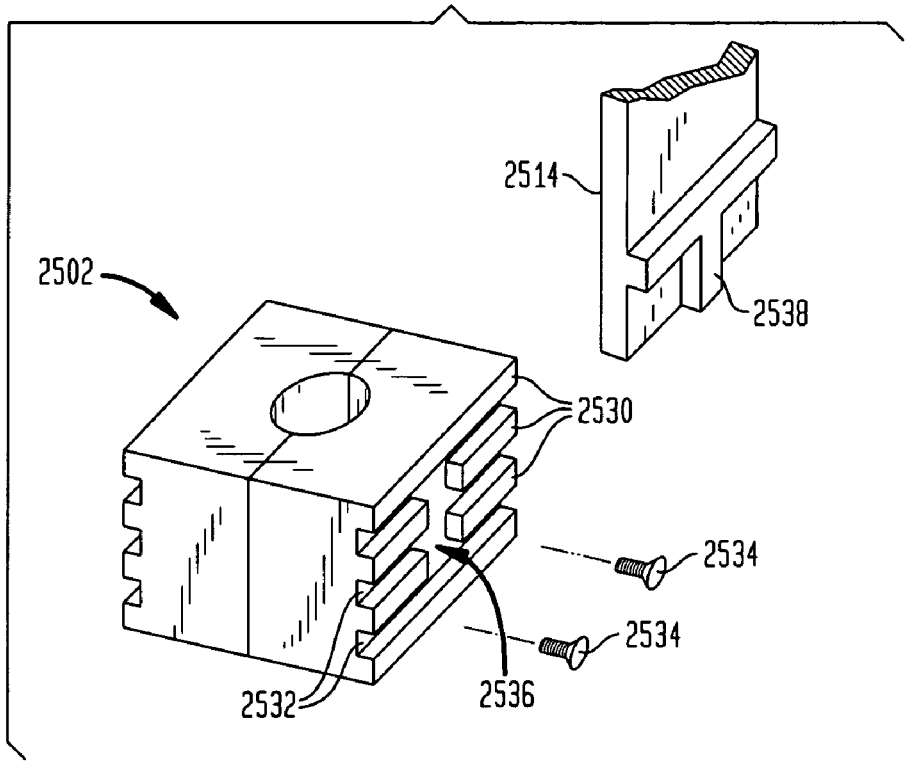

FIG. 25(*a*) illustrates a hanger mechanism 2500 including a collar 2502 and a hanger 2504 (not to scale). The collar 2502 preferably has a channel/opening 2550 with a diameter significantly smaller (e.g., 10-15% smaller) than the minimum diameter of the tension element 180 during operation. Prior to attaching the collar 2502 to the tension element 180, the collar region of the tension element 180 is preferably pre-stressed. More preferably, the collar region may be pre-stressed by a load significantly greater (e.g., 25% greater) than the working load of the tension element 180, stretching the collar region sufficiently to reduce its diameter to approximately the diameter of the collar channel 2550. Then the collar 2502 is attached over the collar region. Because the collar region is pre-stressed into approximately the profile the tension element 180 will assume under load, no additional stresses are added to the working load. Tests have shown that when such collars are used failures do not occur near the hanger mechanism 2500. Instead, the rubber fails at random locations along the length of the tension element 180. This indicates that the hanger mechanism 2500 does not contribute to failures.

Figure 26A:
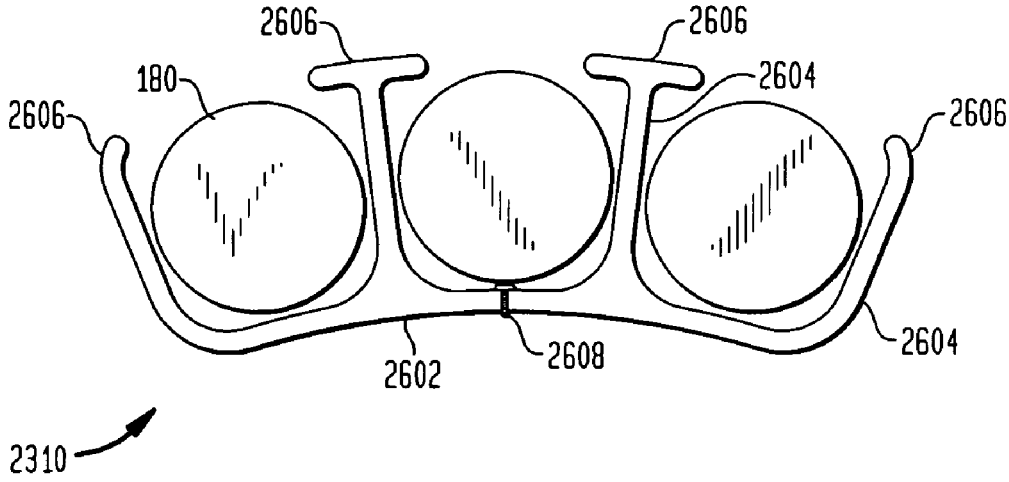
FIGS. 26*a-c* illustrate views of an internal retention apparatus in accordance with aspects of the present invention.
Figure 26B:
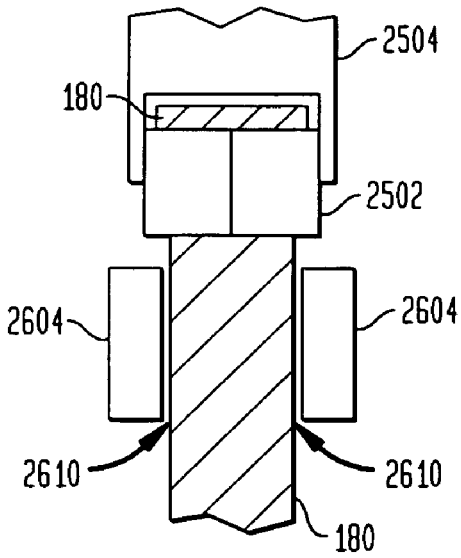
Figure 26C:
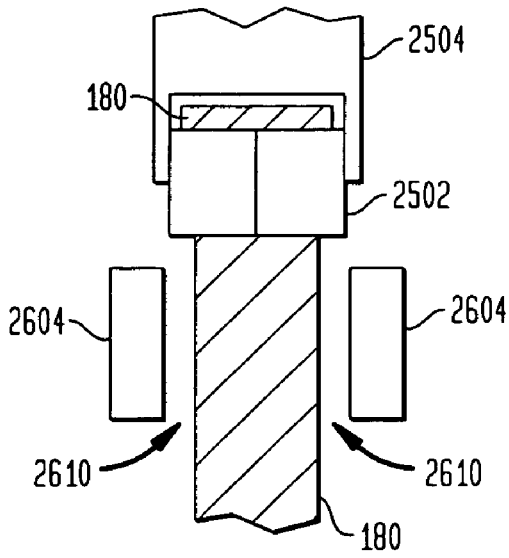

In a typical situation, the working elongation may be on the order of 300%. In this case, elongation during collar attachment should exceed 300%. In a preferred example, elongation is on the order of 400% during attachment. In another example, the attachment elongation is between 300% and 500%. As seen in FIGS. 26(*b*)-(*c*), an end portion of the tension element 180 preferably protrudes from the collar 2502. The resistance of this portion to compression, rather than friction, is what primarily anchors the tension element 180 and prevents it from pulling out of the collar 2502.

The collar 2502 may be comprised of two halves 2506*a,b*. The halves 2506*a,b* are preferably identical and have reciprocal mating features. This will reduce manufacturing costs, including tooling and assembly. As seen in FIG. 25(*a*), the mating features may be protrusions 2508 that are received by recesses 2510. Alternatively, the two halves 2506*a,b* may be attached together by an adhesive, screws, locking clips or other means of fixation. As a further alternative, the two halves 2506*a,b* may be flat plates that are attached together.

Once the collar 2502 is attached to the tension element 180, the hanger 2504 is preferably connected to the collar 2502. As seen in FIG. 25(*a*), the hanger 2504 has a central portion 2512 connected to a pair of arms 2514 and one end and to an endpiece 2516 at the other end. The pair of arms 2514 may have protrusions or bosses 2518 for mating with recesses 2520 on opposing faces 2521 of the collar 2502. Alternatively, as seen in FIG. 25(*b*), the pair of arms 2514 may include a pair of holes or recesses 2522 for mating with protrusions or bosses 2524 on the collar 2502. The collar 2502 and the hanger 2504 may be formed as a one-piece unit or may be fabricated separately and connected together. In one example, the collar 2502 and the hanger 2504 are formed as a one-piece cast metal hanger having fingers that can be crimped around the tension element 180.

The endpiece 2516 may be, e.g., integrally molded to the other parts of the hanger 2504, or may be fabricated separately and then attached to the hanger 2504. Different endpieces 2516 may be used depending upon whether they are employed as a lower hanger or an upper hanger. The lower hanger is preferably implemented as described above with respect to the lower hanger mechanism 2332 and FIGS. 24(*a*)-(*b*). The upper hanger may be implemented as the upper hanger mechanism 2322 shown in FIG. 23(*b*), or may have any of the other structures shown and described in the instant application, for example as seen in FIGS. 18(*a*), 19(*a*) or 20(*b*).

It is also possible to implement the hanger mechanism 2500 without a full hanger 2504. As seen in FIG. 25(*c*), the collar 2502 may include one or more extensions or ridges 2530 and grooves 2532, which can take the place of the extensions 2334 and grooves 2336 in the lower hanger mechanism 2332. By implementing the ridges 2530 and grooves 2532, it reduces the number of pieces to fabricate, can reduce cost, and reduces the overall height of the hanger mechanism 2500. For an endpiece 2516 acting as the upper hanger, the collar 2502 having the ridges 2530 and the grooves 2532 can still be used. In this case, a break or spacing 2536 can be added in some of the ridges 2530. A corresponding ridge 2538 can be placed on the face of the hanger/bracket 2514. As seen in the figure, the ridge 2538 may be T-shaped. Fasteners 2534 can be inserted through holes (not shown) in the halves of the collar 2502 to secure the halves together. The bracket/hanger 2514 is preferably snap-fit to the collar 2502.

Another issue discussed earlier relates to semi-mounted internal storage of the tension elements 180 within the bouncing apparatus. Internal storage is preferred because unused tension elements 180 do not have to be removed from the device. This reduces the possibility of losing unused tension elements 180, and also makes it easier to re-engage the tension elements 180 when they are needed. Preferably, unhooking or otherwise disconnecting one end of a tension element 180 disengages the unused tension element 180. It is possible to store the semi-mounted tension element 180 by using a storage rack internal to the bouncing apparatus. A small amount of tension would keep the unused tension element 180 connected to the storage rack. However, due to the concerns of creeping and overextension, it may be difficult to account for any lengthening of the tension element 180 and, in turn, difficult to ensure the unused tension element 180 remains securely stored. Therefore, it is preferable to store the unused tension element 180 in an untensioned fashion.

In order to implement untensioned semi-mounted internal storage, the unused tension element 180 should be restrained so that it does not adversely impact operation of the bouncing apparatus by, e.g., flopping around and contacting adjacent operative tension elements 180. FIGS. 23(*b*)-(*c*) illustrate holsters 2310 that contain the unused tension element 180. FIG. 26(*a*) illustrates a top-down view of the holster 2310. As seen in FIG. 26, the holster 2310 preferably includes a rear wall 2602 having multiple sidewalls 2604 extending outward. Front members 2606 are at the ends of the sidewalls 2604. The front members 2606 may be "T" shaped, curved, arched etc., and may be adjustable to so the tension element 180 is completely or substantially encircled. The main reason to leave an opening along one of the sides is to permit the spring/tension element 180 to be installed from the side. Thus, the holster 2310 need not completely surround or encompass the tension element 180. Another option is to install the tension element 180 from the bottom (or top), so long as the collar 2502 is small enough to permit insertion in this manner. As is evident from the figure, the rear wall 2602, sidewalls 2604 and front members 2606 restrain the tension elements 180. The holster 2310 may be secured to a component, such as the bearing 170 (see FIG. 1F), by means of one or more fastening mechanisms 2608. The fastening mechanism may be, e.g., a screw, bolt, adhesive, etc. Alternatively, the holster 2310 may be integrally formed with the bearing 170 or other components of the bouncing apparatus.

FIG. 26(*b*) is a side cutaway view (with the front members 2606 omitted) showing the unused tension element 180 retained by the holster 2310. FIG. 26(*c*) is a side view (with the front members 2606 omitted) showing an operative tension element 180 in relation to the holster 2310. As seen in FIG. 26(*b*), the holster 2310 is preferably dimensioned so that it is slightly larger than the unused tension element 180. The unused tension element 180 should not be compressed, as it merely needs to be contained by the holster 2310. Thus, in a preferred example, there is a clearance 2610, which is preferably between 0.01 and 0.1 inches, although larger clearances 2610 are possible. In one example, the clearance 2610 is about 1/16 of an inch. In another example, the clearance 2610 is at least 0.04 inches. The clearance 2610 is exaggerated in the figure. Furthermore, as seen in FIG. 26(*c*), the rear wall 2602, sidewalls 2604 and front members

2606 should be dimensioned so that they do not substantially contact or cause friction when the tension element 180 is being used. Friction or contact can place undue stress or wearing on the tension element 180. In this case when the tension element 180 is being used, there is a second, larger clearance 2612.

As seen in FIG. 26(*b*), in accordance with a preferred example, the collar 2502 may remain above the holster 2310 while the tension element 180 is disconnected. As seen in FIGS. 23(*a*)-(*c*), multiple holsters 2310 may be employed. Alternatively, a single holster 2310 may be used. In this case, at least a portion of the holster 2310 should extend low enough so that the portion of the tension element 180 between the collar 2502 and the lower mount 2330 from buckling out.

Although the invention herein has been described with reference to particular embodiments, it is to be understood that these embodiments are merely illustrative of the principles and applications of the present invention. In some areas where general terms are used and only specific forms are mentioned it will be understood that equivalent forms are also expressed by the general term. It is therefore to be understood that numerous modifications may be made to the illustrative embodiments and that other arrangements may be devised without departing from the spirit and scope of the present invention as defined by the appended claims.

The invention claimed is:

1. A method, comprising:

providing an elastomeric tension element operable to elongate from a first length to a second length during use, the tension element having a first cross-sectional size associated with the first length and a second cross-sectional size associated with the second length, the second length being longer than the first length and the second cross-sectional size being less than the first cross-sectional size, the elastomeric tension element having a collar region at a first point therealong;

pre-stressing the collar region of the elastomeric tension element so that the collar region has a third cross-sectional size less than the second cross-sectional size;

providing a collar having receptacle therein to receive the collar region of the elastomeric tension element, the receptacle including a fourth cross-sectional size less than the second cross-sectional size of the elastomeric tension element; and fixedly attaching the collar receptacle to the collar region.

2. The method of claim 1, wherein the collar region is pre-stressed to an elongation of between 300% and 500%.

3. The method of claim 1, further comprising connecting a hanger to the collar, wherein the hanger is connectable to a mount of a bouncing apparatus.

4. The method of claim 1, wherein the collar includes a pair of collar portions, and fixedly attaching the collar includes mating the pair of collar portions together around the collar region.

5. The method of claim 4, wherein the pair of collar portions are substantially identical.

6. The method of claim 4, wherein the pair of collar portions have reciprocal mating features and fixedly attaching the collar includes securing the reciprocal mating features together.

7. The method of claim 1, wherein the fourth cross-sectional size of the collar is at least as large as the third cross-sectional size of the pre-stressed collar region.

8. The method of claim 1, further comprising de-stressing the collar region upon attachment of the collar.

9. The method of claim 1, wherein the collar receptacle include a plurality of fingers and fixedly attaching the collar includes crimping the fingers about the collar region.

10. The method of claim 1, wherein the first point along the tension element is adjacent a first end of the tension element, and upon fixedly attaching the collar to the collar region the first end of the tension element has a fifth cross-sectional size greater than the fourth cross-sectional size of the collar.

11. The method of claim 1, wherein the fourth cross-sectional size is at least about 10% smaller than the second cross-sectional size.

* * * * *